US010470571B2

(12) United States Patent
Ott

(10) Patent No.: US 10,470,571 B2
(45) Date of Patent: Nov. 12, 2019

(54) PULL-OUT GUIDE FOR A FURNITURE PART

(71) Applicant: Fulterer AG & Co KG, Lustenau (AT)

(72) Inventor: Dominic Ott, Eschen (LI)

(73) Assignee: Fulterer AG & Co KG, Lustenau (AT)

( * ) Notice: Subject to any disclaimer, the term of this patent is extended or adjusted under 35 U.S.C. 154(b) by 0 days.

(21) Appl. No.: 15/939,751

(22) Filed: Mar. 29, 2018

(65) Prior Publication Data

US 2018/0279780 A1 Oct. 4, 2018

(30) Foreign Application Priority Data

Mar. 31, 2017 (AT) ..... A 137/2017

(51) Int. Cl.

| | |
|---|---|
| ***A47B 88/50*** | (2017.01) |
| ***A47B 88/473*** | (2017.01) |
| *B25H 3/02* | (2006.01) |
| *A47B 88/49* | (2017.01) |

(52) U.S. Cl.

CPC ..... *A47B 88/473* (2017.01); *A47B 88/50* (2017.01); *A47B 88/49* (2017.01); *B25H 3/02* (2013.01)

(58) Field of Classification Search

CPC ..... A47B 88/473; A47B 88/50; A47B 88/49; A47B 88/57; A47B 2210/0018; A47B 2210/0016; A47B 2210/0081; A47B 2210/0056; A47B 2088/4235; B25H 3/02; F16C 2314/72

USPC ..... 312/333, 334.7, 334.44, 319.1, 334.46, 312/334.6; 384/21, 22

See application file for complete search history.

(56) References Cited

U.S. PATENT DOCUMENTS

| | | | | |
|---|---|---|---|---|
| 5,405,195 A * | 4/1995 | Hobbs | A47B 88/57 312/334.32 |
| 5,961,193 A * | 10/1999 | Hobbs | A47B 88/493 312/333 |
| 8,231,188 B1 * | 7/2012 | Chen | A47B 88/57 312/333 |
| 8,876,230 B2 * | 11/2014 | Lowe | A47B 88/493 312/333 |

(Continued)

FOREIGN PATENT DOCUMENTS

| | | |
|---|---|---|
| DE | 4307911 | 9/1994 |
| DE | 19502526 | 2/1996 |

(Continued)

*Primary Examiner* — Janet M Wilkens

(74) *Attorney, Agent, or Firm* — Volpe and Koenig, P.C.

(57) ABSTRACT

A pull-out guide for a furniture part (2) which can be pulled out of a furniture cabinet (1) includes a cabinet rail (3) which is attachable to the furniture cabinet (1), a pull-out rail (5) which is attachable to the pull-out furniture part (2), and a bolt part (10) for blocking the pulling out of the pull-out rail from an insertion position of the pull-out rail (5), and/or for blocking the pushing in of the pull-out rail (5) from an extension position of the pull-out rail (5). The bolt part (10) is displaceable by an actuating element (13, 13') from a blocking position, in which the bolt part (10) is acted upon by a spring element (12), in a displacement direction (11) into a release position, wherein, during the pulling out and pushing in of the pull-out rail (5), the bolt part (10) slides or rolls along a running track (23) of the cabinet rail (3) and is pressed onto the running track (23) by the spring element (12).

18 Claims, 17 Drawing Sheets

(56) References Cited

U.S. PATENT DOCUMENTS

| | | | | |
|---|---|---|---|---|
| 2005/0162052 | A1* | 7/2005 | Chen | A47B 88/50<br>312/334.5 |
| 2008/0111382 | A1 | 5/2008 | Duan et al. | |
| 2016/0174707 | A1* | 6/2016 | Chan | E05C 17/02<br>312/333 |
| 2018/0031037 | A1* | 2/2018 | Chen | F16C 29/10 |
| 2018/0288897 | A1* | 10/2018 | Yoneda | H05K 7/183 |

FOREIGN PATENT DOCUMENTS

| | | | |
|---|---|---|---|
| DE | 10201242 | | 7/2003 |
| EP | 1826343 | | 7/2009 |
| EP | 3157313 | * | 4/2017 |
| WO | 2010129303 | | 11/2010 |

* cited by examiner

A
B
1
2
3
3a
4
5
6
7
8
10
10a
11
12
13
14
15
16
18
19
21
23

10a
10
9
11
12
18
20
21
16
XX
PA
10b
10c
17
27

PULL-OUT GUIDE FOR A FURNITURE PART

INCORPORATION BY REFERENCE

The following documents are incorporated herein by reference as if fully set forth: Austrian Patent Application No. A137/2017, filed Mar. 31, 2017.

BACKGROUND

The invention relates to a pull-out guide for a furniture part which can be pulled out of a furniture cabinet, comprising a cabinet rail which is attachable to the furniture cabinet, a pull-out rail which is attachable to the pull-out furniture part and can be pulled out in a pull-out direction from a completely pushed-in insertion position into a completely pulled-out extension position, and can be pushed into the insertion position from the extension position counter to the pull-out direction, and a bolt part for blocking the pulling out of the pull-out rail from the insertion position of the pull-out rail, and/or for blocking the pushing in of the pull-out rail from the extension position of the pull-out rail, wherein the bolt part is adjustable by an actuating element from a blocking position, in which the bolt part blocks the pulling out of the pull-out rail from the insertion position of the pull-out rail or blocks the pushing in of the pull-out rail from the extension position of the pull-out rail, into a release position, in which the bolt part releases the pulling out of the pull-out rail from the insertion position of the pull-out rail or releases the pushing in of the pull-out rail from the extension position of the pull-out rail, and, in the insertion position of the pull-out rail and/or in the extension position of the pull-out rail, the bolt part is held in the blocking position by a spring element and is adjustable from the blocking position into the release position counter to the force of the spring element by actuation of the actuating element, and, during the pulling out and pushing in of the pull-out rail, the bolt part slides or rolls along a running track of the cabinet rail, the bolt part being pressed onto the running track by the spring element.

In the case of furniture parts which can be pulled out of a furniture cabinet by a pull-out guide, for example drawers, it may be desirable to lock the pull-out furniture part in its completely pushed-in position and/or in its completely pulled-out position in order to prevent an inadvertent extension or retraction of the pull-out furniture part. Such locking may be desirable in particular in the case of furniture items which are movable on wheels, such as a movable toolbox, or in the case of furniture items arranged in vehicles.

A locking device for blocking the pull-out furniture part in its completely pushed-in position and in its completely pulled-out position is disclosed, for example, in EP 1 826 343 B1. A blocking lever is attached pivotably to a side wall of the drawer and is pivotable between a blocking position and a release position by a pivotable handle arranged on the front of the drawer. In the pushed-in state of the drawer, a bolt arranged fixed to the cabinet engages in a latching recess of the blocking lever in the blocking position of the blocking lever. In the pulled-out state of the drawer, a stop at the rear end of the blocking lever interacts with a stop arranged fixed to the cabinet in the blocking position. Among the disadvantages of this device is the relatively complicated design and installation.

DE 195 02 526 C1 and DE 43 07 911 A1 disclose pull-out guides of the type mentioned at the beginning. Bolt parts are in each case mounted pivotably on the pull-out rail in regions on both sides next to the pull-out furniture part. In the case of the pull-out guide according to DE 195 02 526 C1, the pivot axis lies parallel to the pull-out direction, and the bolt part is pivoted by a Bowden cable. In the case of the pull-out guide according to DE 43 07 911 A1, the pivot axis of the bolt part lies at a right angle to the pull-out direction, and the pivoting is undertaken by a pivotable actuating lever.

SUMMARY

It is the object of the invention to provide an advantageous pull-out guide of the type mentioned at the beginning, in which the pulling out of the pull-out rail from the insertion position of the pull-out rail and/or the pushing in of the pull-out rail from the extension position of the pull-out rail can be blocked by a bolt part. This is realized by a pull-out guide with one or more features of the invention.

In the case of the pull-out guide of the invention, it is provided that the bolt part is guided by a base part so as to be displaceable parallel to a displacement direction between the blocking position and the release position, wherein, in the insertion position of the pull-out rail and/or in the extension position of the pull-out rail, the bolt part is held in the blocking position by the spring element, and is displaceable from the blocking position in the displacement direction into the release position counter to the force of the spring element by actuation of the actuating element.

A simple, stable and space-saving design is made possible in this case. Fitting on the lower side of a pull-out furniture part is especially made possible, with the displacement direction lying horizontally.

In addition, a flexibly adaptable design can be made possible for the actuation of the bolt part, as explained more precisely further below.

During the pulling out or pushing in of the pull-out rail, the bolt part slides along a running track of the cabinet rail or rolls along said running track. The bolt part is pressed here against the running track by the spring element. The release position of the bolt part will therefore be maintained by interaction of the bolt part with the running track during the pulling out and pushing in of the pull-out rail. A latching mechanism therefore does not have to be provided for the bolt part in order to hold said bolt part in the release position during the pulling out or pushing in of the pull-out rail after the bolt part has been adjusted from the blocking position into the release position by the actuating element. When, during the pulling out and/or pushing in of the pull-out rail, the end position of the pull-out rail (extension position and/or insertion position) is reached, in which locking of the pull-out rail is provided, the bolt part passes beyond the end of the running track and is automatically pushed into its blocking position by the spring element. When the insertion position and/or extension position is reached, the pull-out rail can therefore be automatically blocked, specifically advantageously without a force opposing the displacement of the pull-out rail having to be applied here by the pull-out rail in order to bring the bolt part from its release position into its blocking position.

The stop surface with which the bolt part interacts in the blocking position, in order to block the pulling out or pushing in of the pull-out rail, is preferably arranged on the cabinet rail. In order to block the pulling out of the pull-out rail from the insertion position of the pull-out rail, the stop surface points in the direction opposed to the pull-out direction. In order to block the pushing in of the pull-out rail from its extension position, the stop surface points in the pull-out direction. By arranging the stop surface on the cabinet rail, it is not necessary to mount a separate stop part, which has the stop surface, on the furniture cabinet.

The base part of the bolt unit can be arranged on the pull-out rail in a different manner, for example by fastening screws or, for example, by welding, as a result of which an integral design would be present.

A first advantageous embodiment of the invention makes provision for the actuating element to be connected to the bolt part via a traction cable. Flexible positioning of the actuating element is thereby made possible. In an advantageous manner, a tensioning part which is acted upon by a tensioning spring acts on the traction cable in order to keep the latter tensioned. The traction cable thereby remains tensioned even when, during the pulling out and pushing in of the pull-out rail, the bolt part slides or rolls along the running track of the cabinet rail (and no actuation of the actuating element by the user takes place).

In a second advantageous embodiment of the invention, the actuating element is connected to the bolt part via an axially displaceable actuating rod and at least one gear element. The actuating element can then be, for example, a button which is arranged at that end of the actuating rod which is remote from the locking part. The bolt part can be displaced from its blocking position into its release position by pushing in of the actuating element and therefore of the actuating rod. However, a design in which this is achieved by pulling out the actuating element and therefore the actuating rod is also conceivable and possible. Pushing in or pulling out of the actuating rod could also be undertaken by a separate, displaceably or pivotably mounted, actuating element, wherein said actuating element interacts with the actuating rod directly or via at least one gear element.

The at least one gear element lying between the actuating rod and the bolt part can be designed in different ways. For example, it can be an actuating arm which lies between said two parts, stands obliquely with respect to the displacement direction of the bolt part and is pivotable both in relation to the actuating rod and in relation to the bolt part. A wedge element which is attached to the actuating rod (is possibly formed integrally therewith) or is actuated by the actuating rod could also be provided, for example.

BRIEF DESCRIPTION OF THE DRAWINGS

The design according to the invention also permits simple optional fitting with a traction cable or an actuating rod as the transmission element.

Further advantages and details of the invention are explained below with reference to the attached drawing, in which:

FIG. 63 shows a section corresponding to FIG. 61, but in the state which is present when the bolt part slides along the running track during the pulling out or pushing in;

DETAILED DESCRIPTION OF THE PREFERRED EMBODIMENTS

The figures have different scales.

Figures 1, 2, 3:
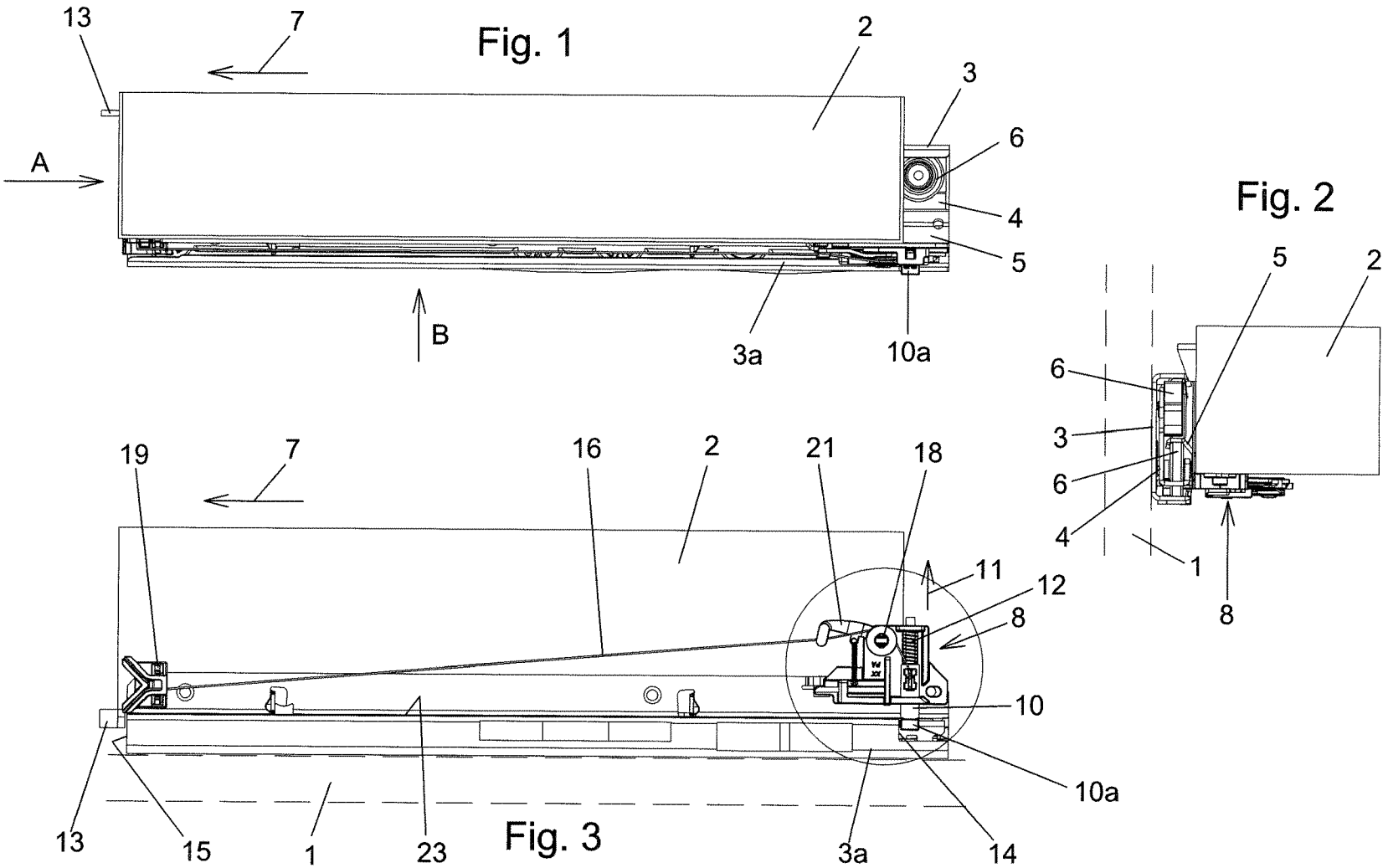
FIG. 1 shows a side view of part of a pull-out furniture part with the pull-out guide rails which are attached to the pull-out furniture part on one side thereof, according to a first exemplary embodiment of the invention, in the completely pushed-in insertion position of the pull-out rail of the pull-out guide.
FIG. 2 shows an end-side view, viewing direction A of FIG. 1, wherein the furniture cabinet is also indicated by dashed lines.
FIG. 3 shows a view from below, viewing direction B in FIG. 1.
Figures 4, 5, 6:
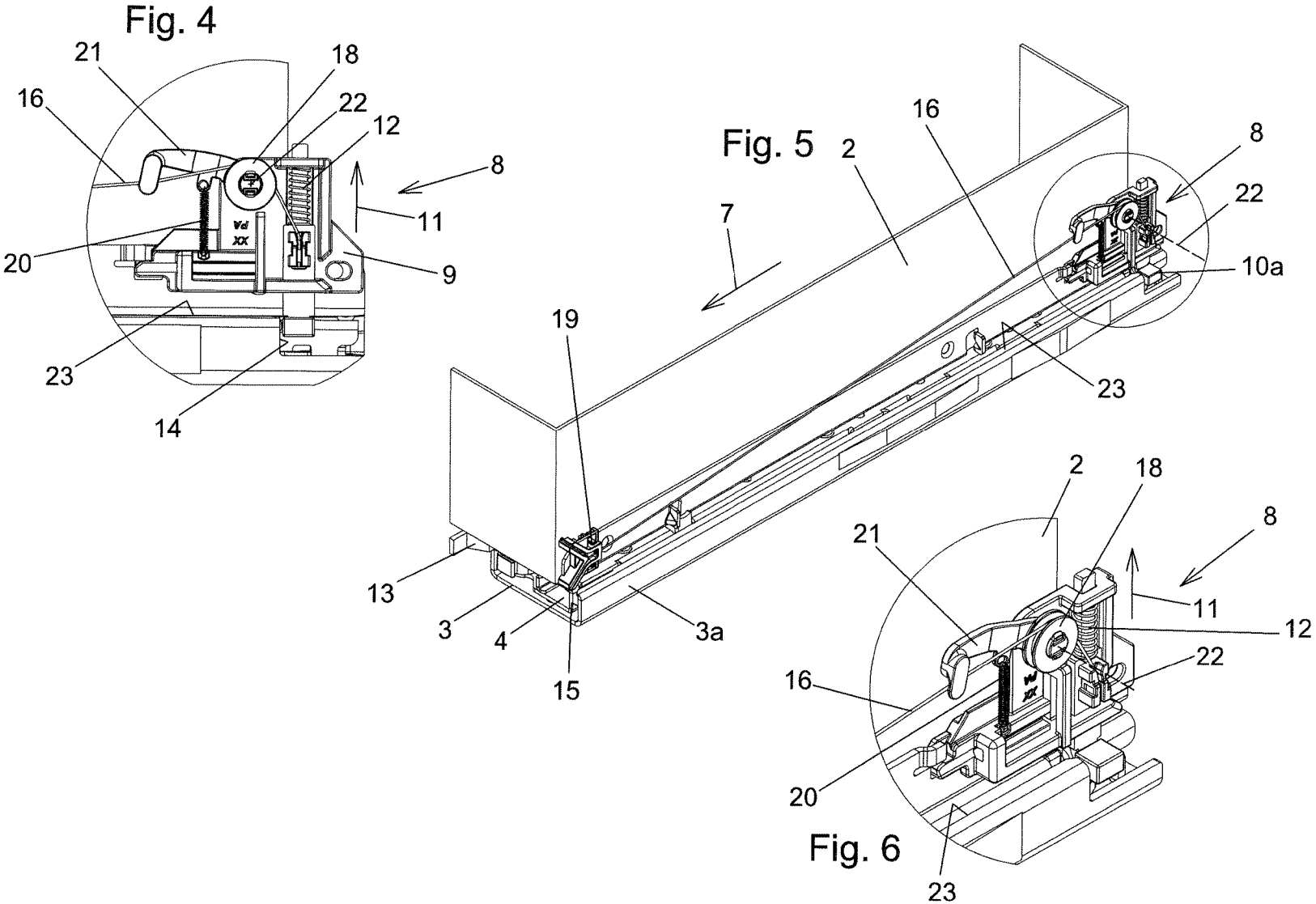
FIG. 4 shows an enlarged detail of FIG. 3.
FIG. 5 shows a perspective view obliquely from below.
FIG. 6 shows an enlarged detail of FIG. 5.
Figure 8:
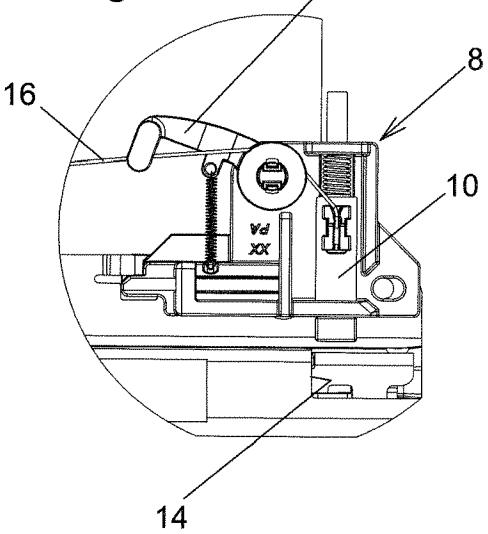
FIG. 7 to FIG. 10 show illustrations corresponding to FIGS. 3-6, wherein the bolt part has been displaced from the blocking position into the release position.
Figure 10:
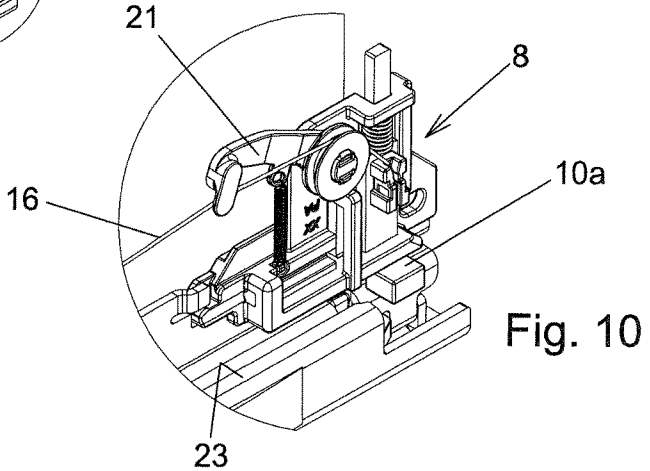
Figure 7:
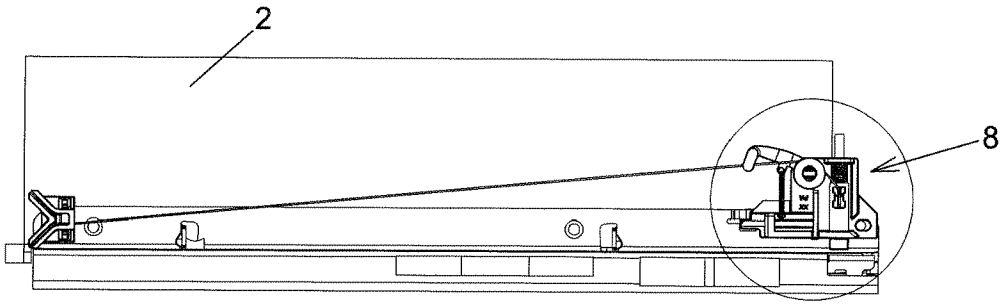
Figure 9:
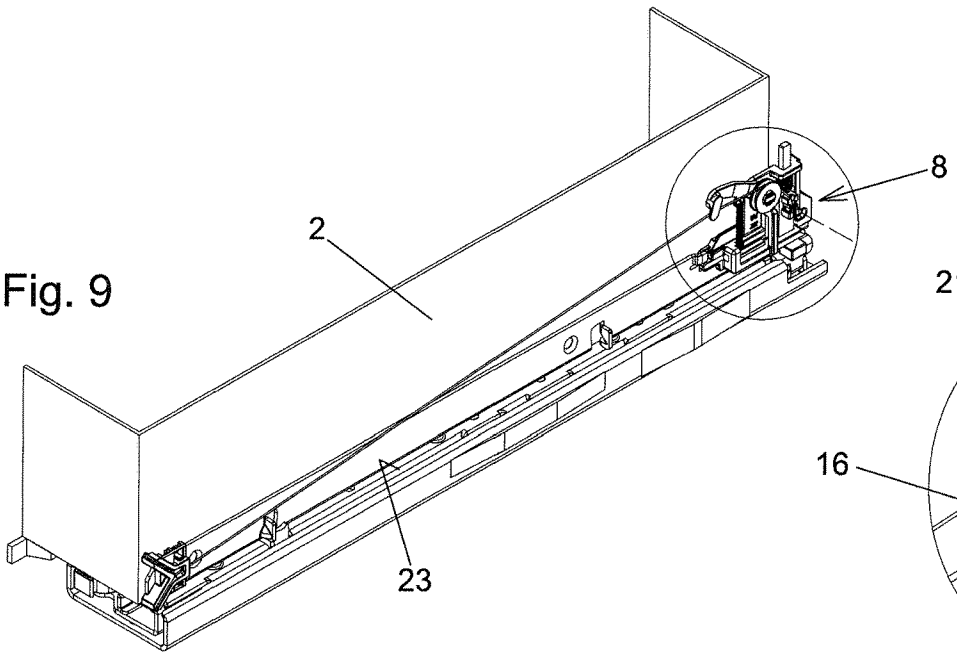
Figure 12:
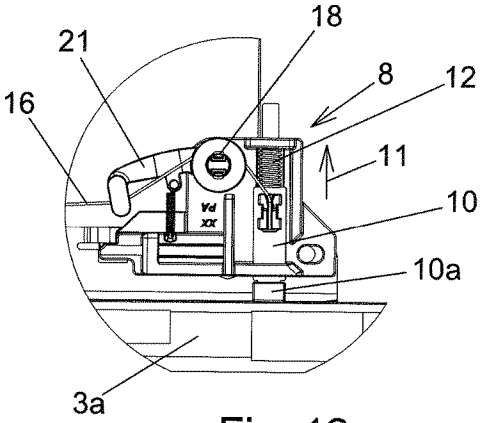
FIG. 11 to FIG. 14 show illustrations corresponding to FIGS. 3-6, in a position of the pull-out rail which lies between the insertion position and the extension position.
Figure 14:
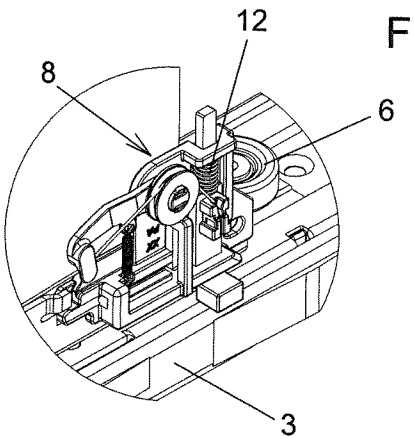
Figure 11:
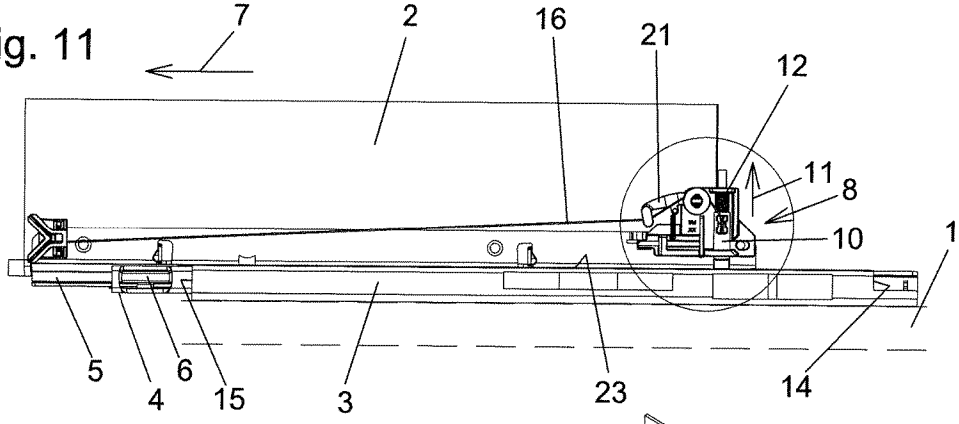
Figure 13:
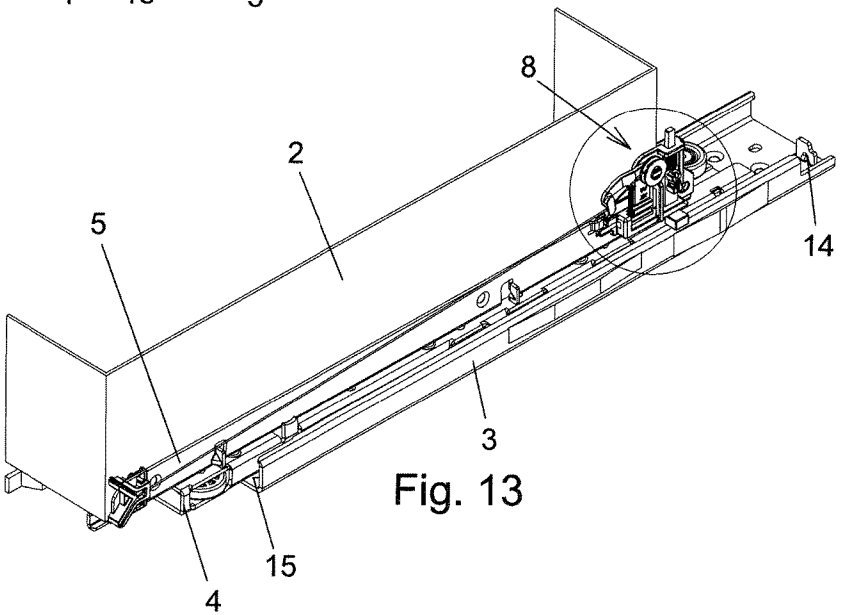
Figure 15:
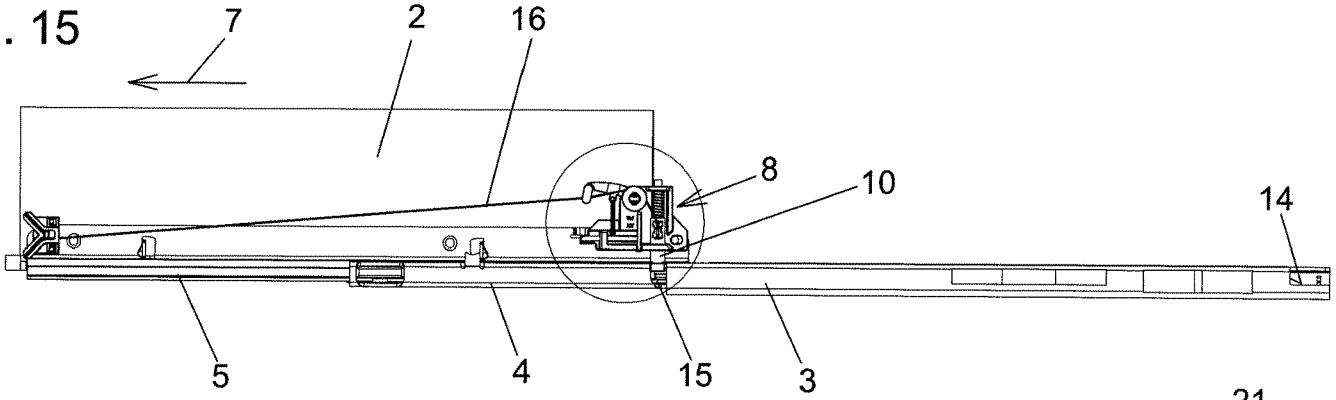
FIG. 15 to FIG. 18 show illustrations corresponding to FIGS. 3-6, in the extension position of the pull-out rail, in which the latter is blocked by the bolt part.
Figure 16:
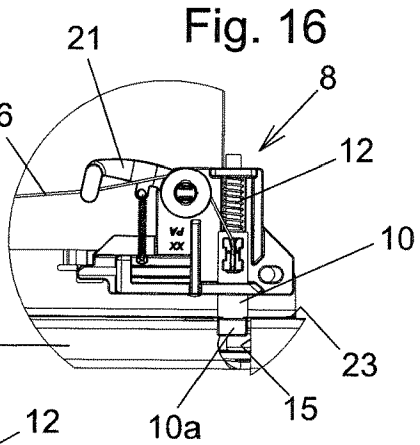
Figure 17:
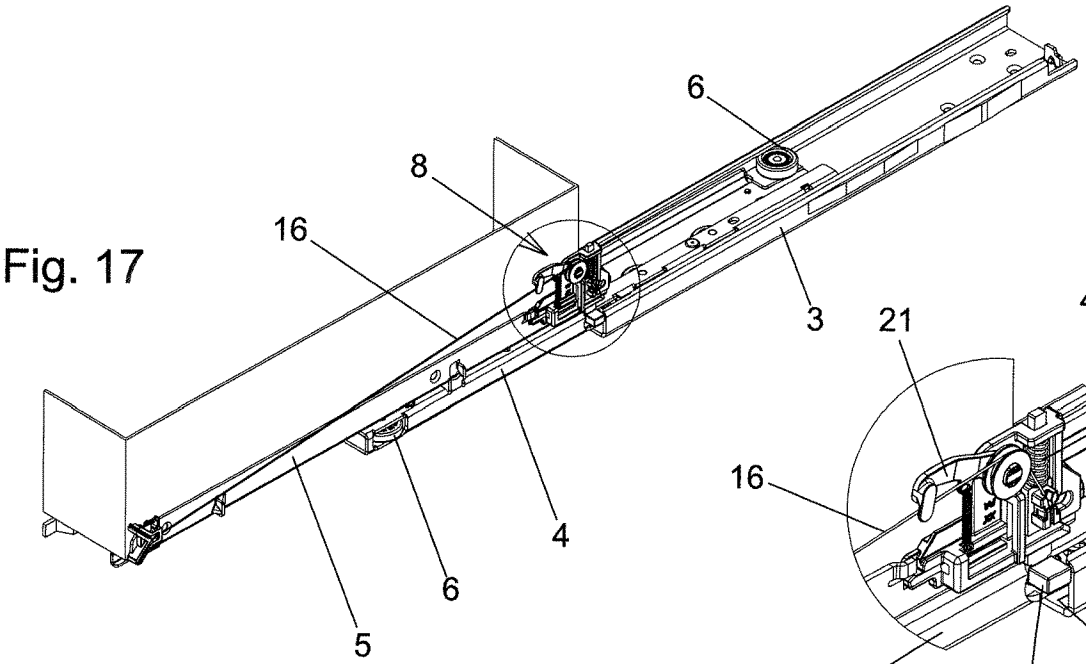
Figure 18:
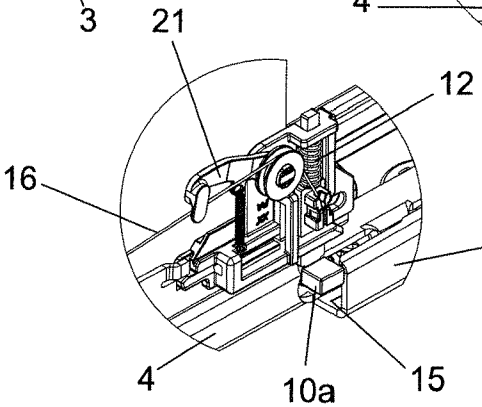
Figure 19:
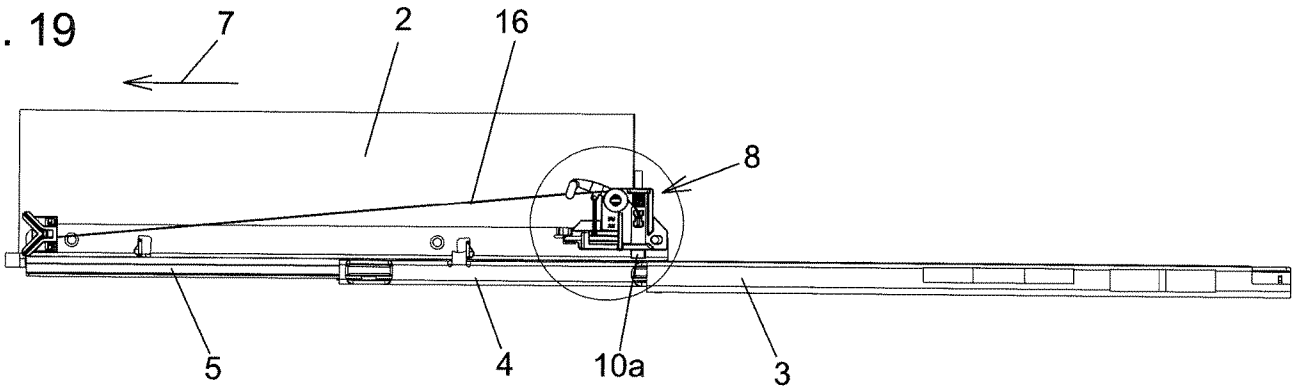
FIG. 19 to FIG. 22 show illustrations corresponding to FIG. 3-6, in the extension position of the pull-out rail and with the bolt part adjusted from the blocking position into the release position.
Figure 20:
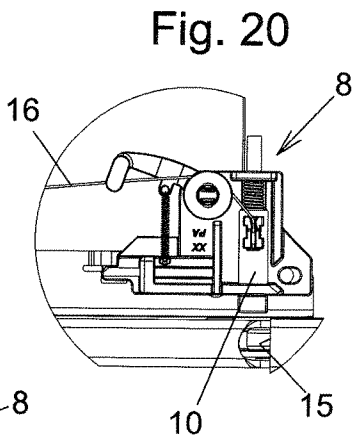
Figure 21:
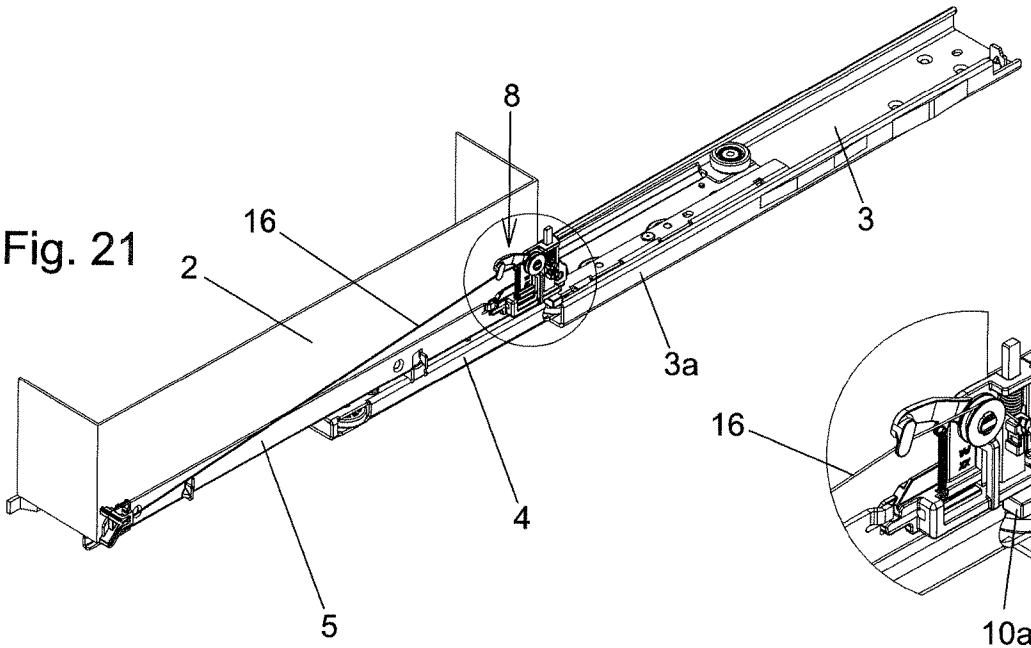
Figure 22:
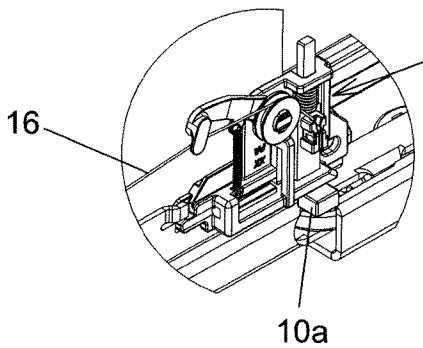
Figures 23, 24, 25, 26:
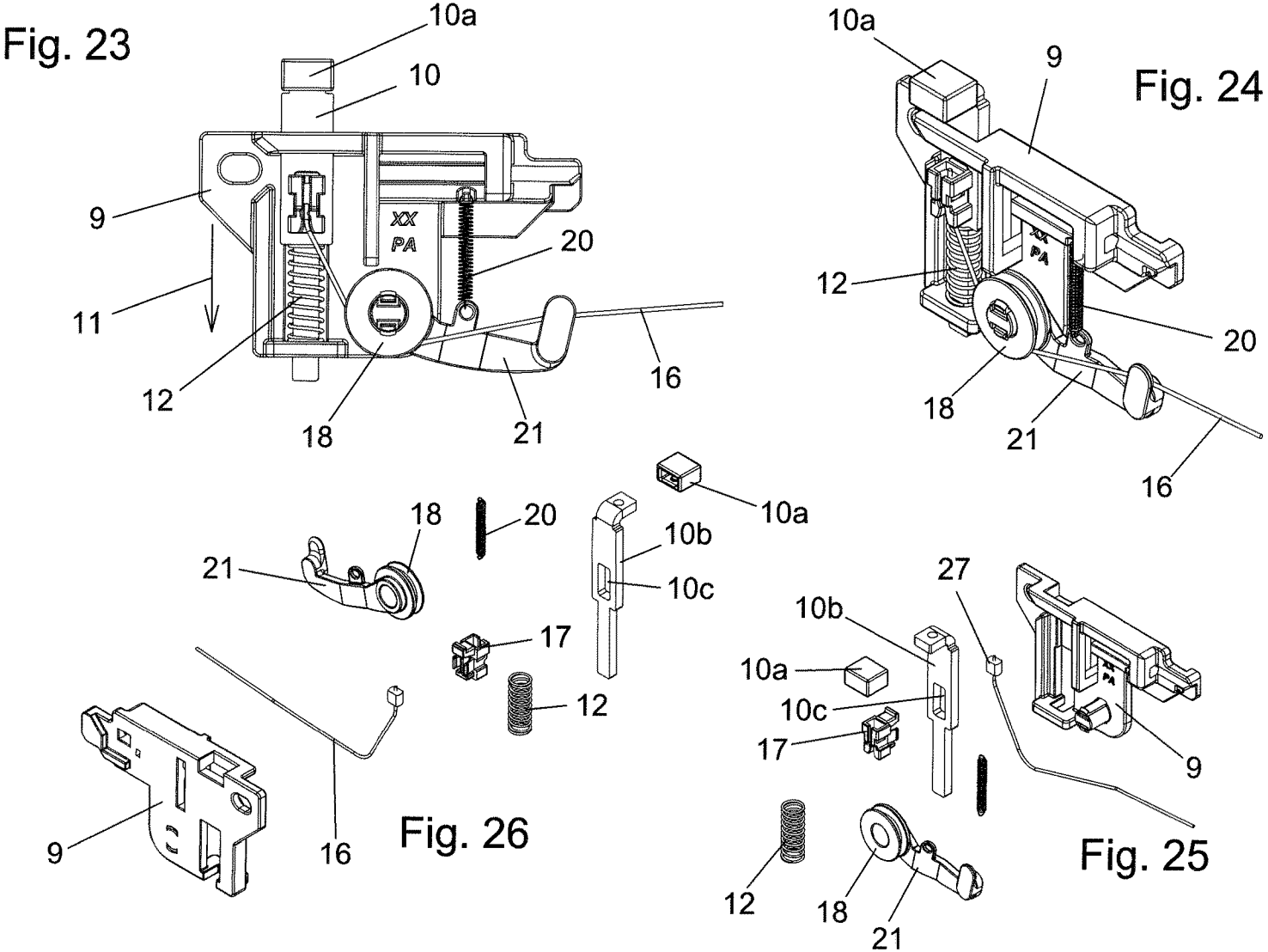
FIGS. 23 and 24 show a side view and a perspective view of the bolt unit which is attached to the pull-out rail, with an end portion of the traction cable.
FIGS. 25 and 26 show exploded illustrations of the bolt unit and of the end portion of the traction cable from different viewing directions.
Figure 28:
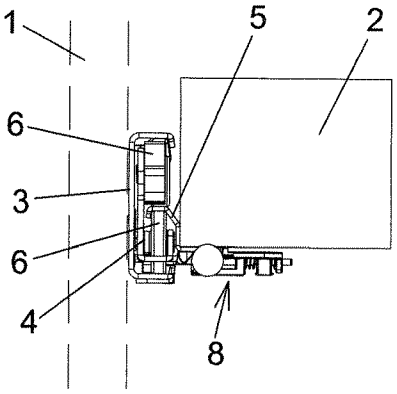
FIG. 27 to FIG. 50 show illustrations corresponding to FIGS. 1 to 24 for a second exemplary embodiment of the invention.
Figure 27:
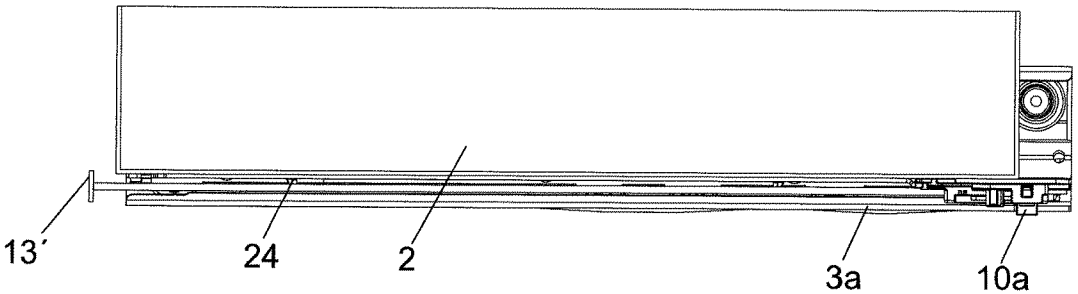
Figure 29:
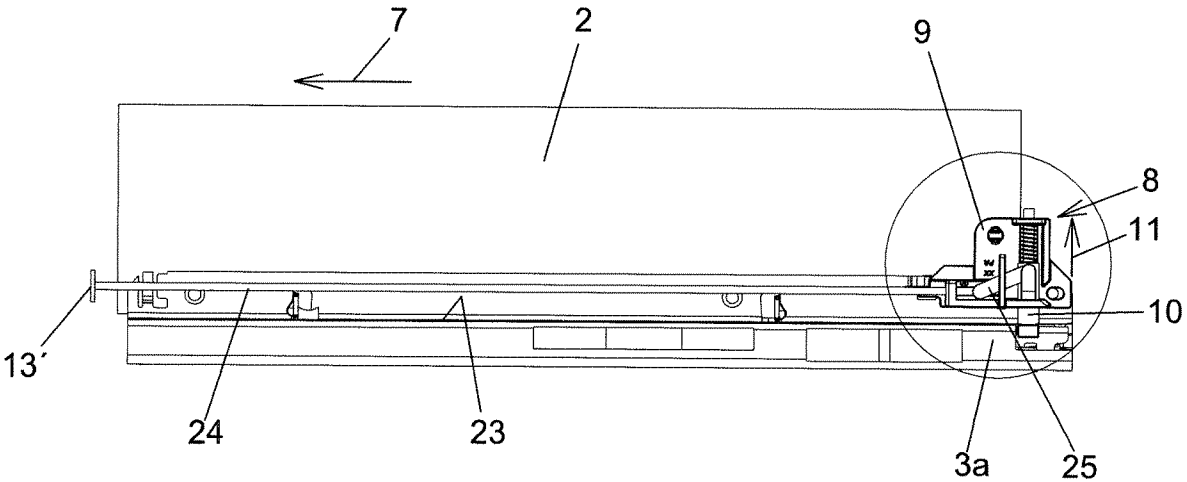
Figure 31:
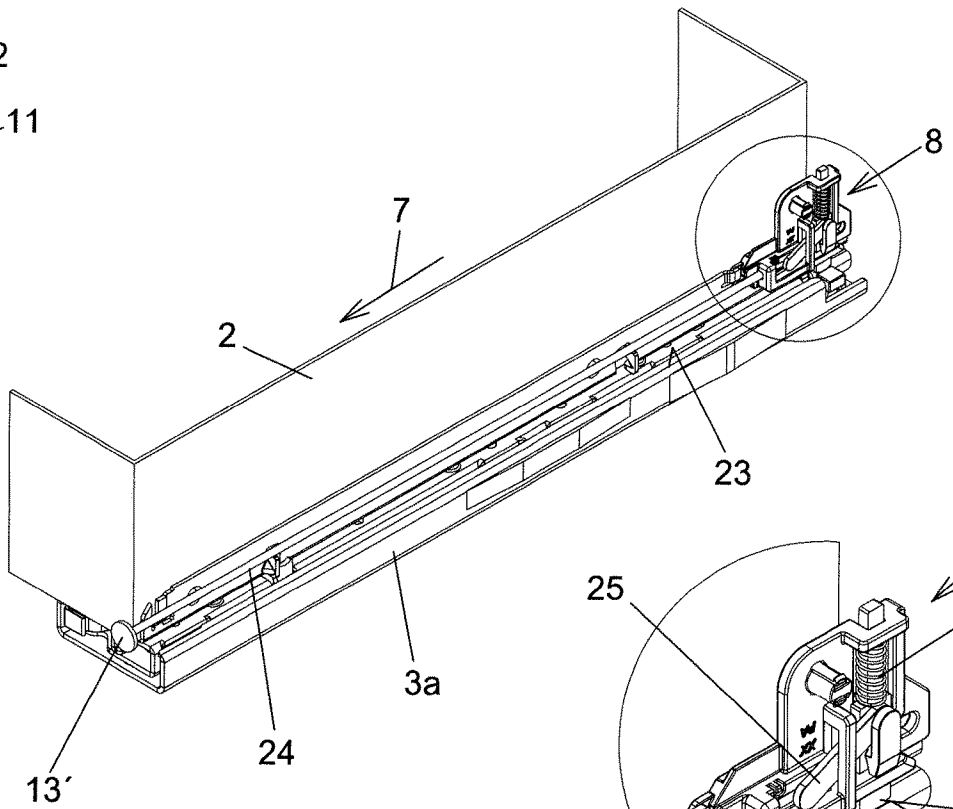
Figure 32:
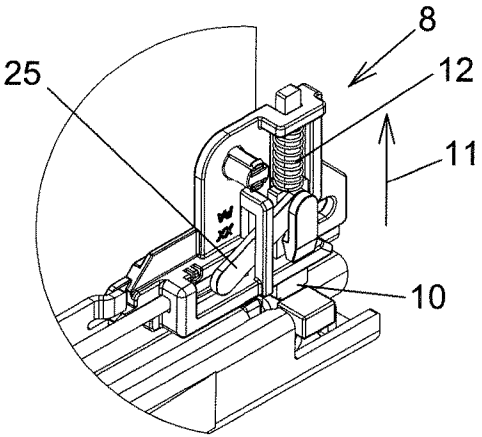
Figure 30:
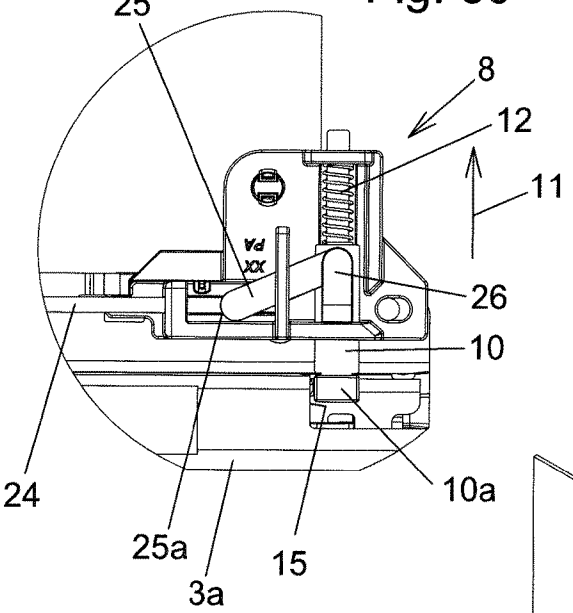
Figure 33:
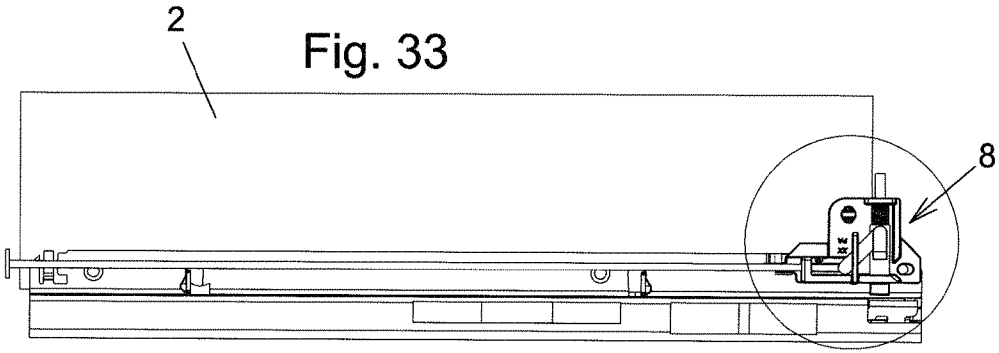
Figure 34:
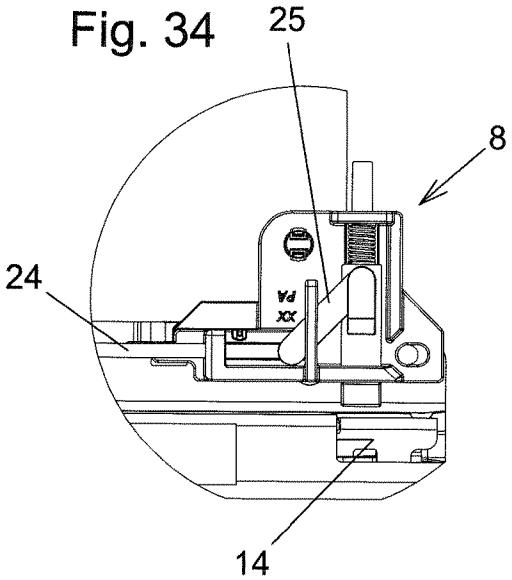
Figure 35:
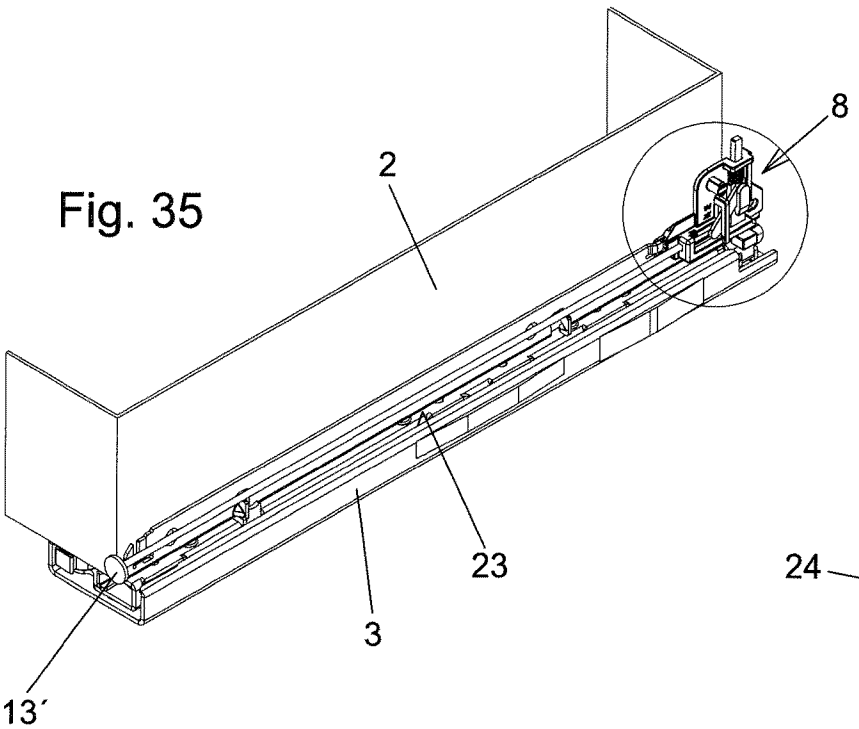
Figure 36:
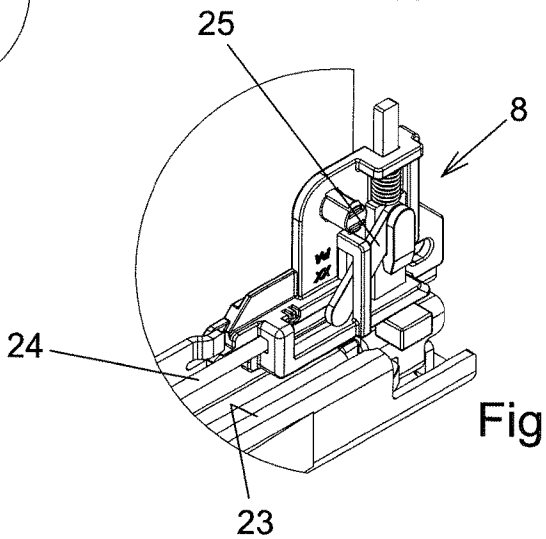
Figure 38:
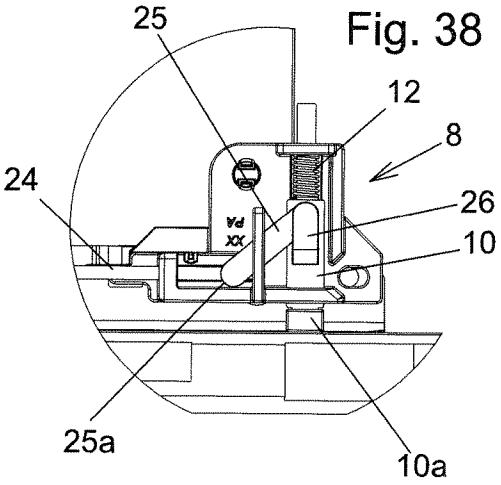
Figure 40:
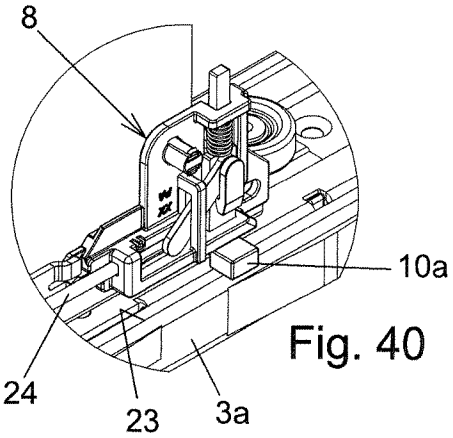
Figure 37:
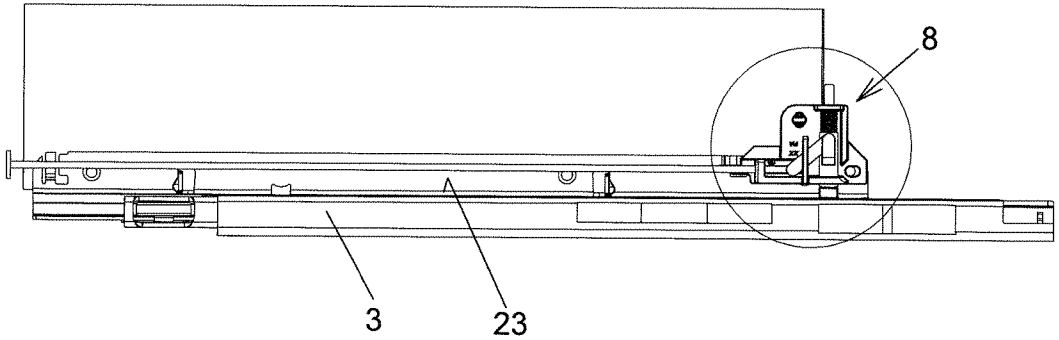
Figure 39:
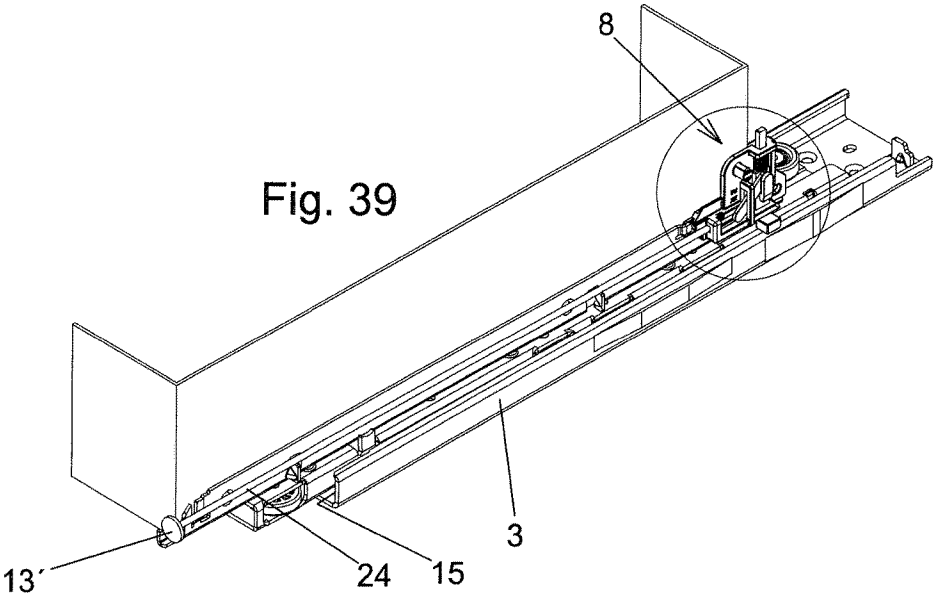
Figures 41, 42, 43, 44:
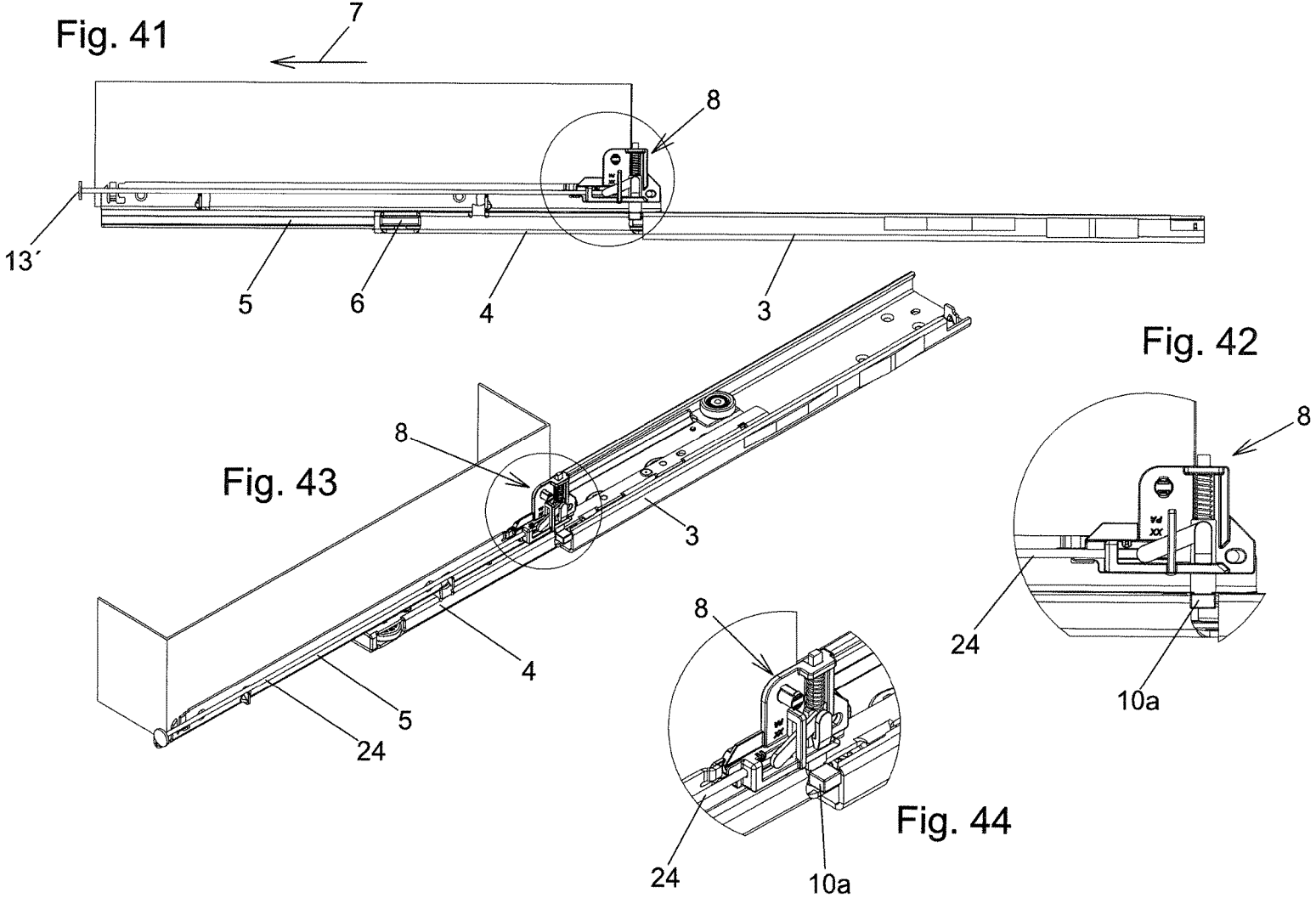
Figure 45:
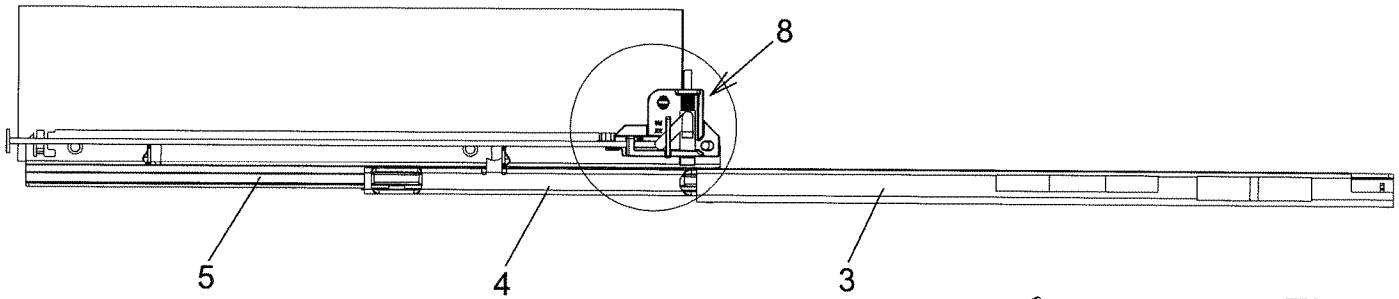
Figure 46:
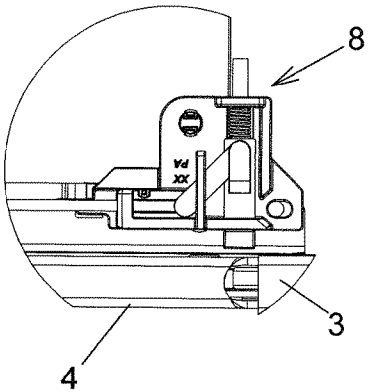
Figure 47:
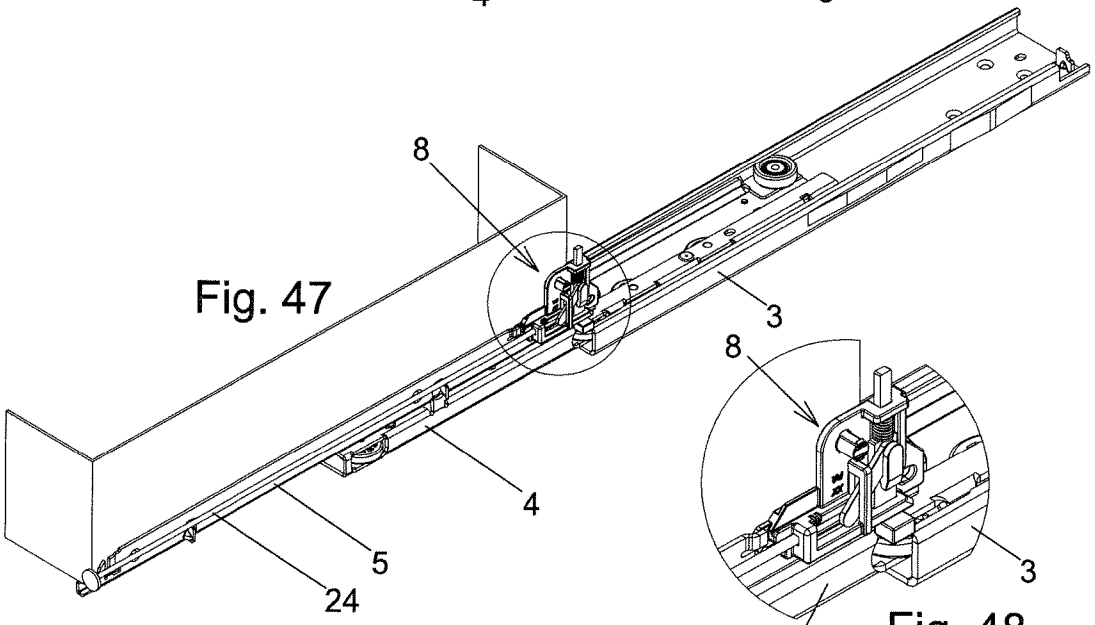
Figure 48:
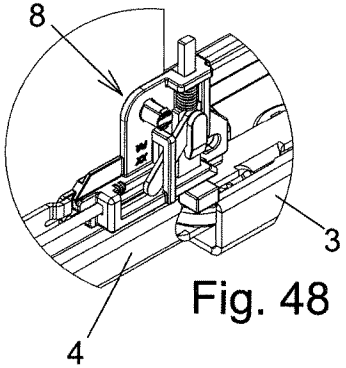
Figure 51:
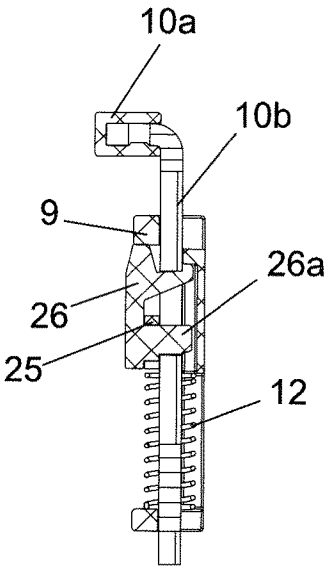
FIG. 51 shows a section along the line CC from FIG. 49.
Figure 49:
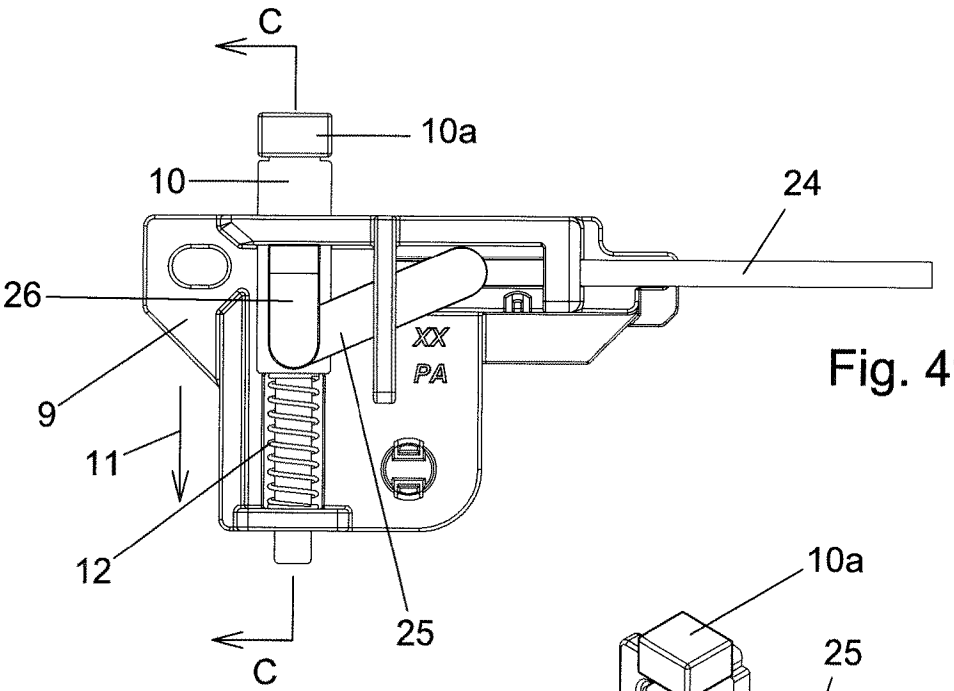
Figure 50:
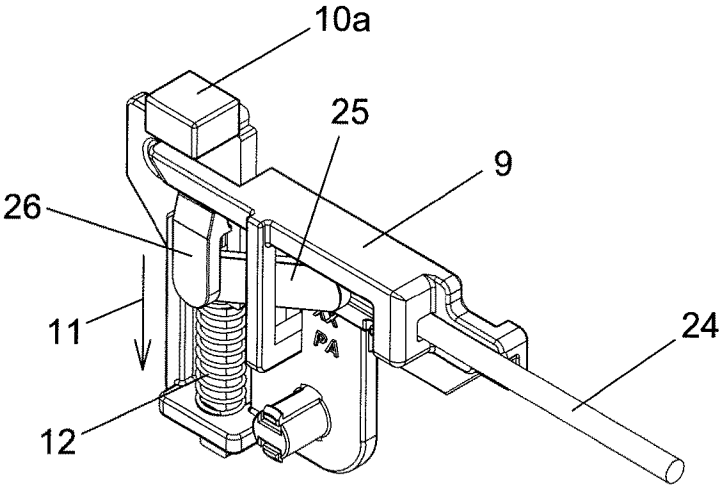

A first exemplary embodiment of a pull-out guide according to the invention with a bolt device for securing the pulling out and pushing in of a pull-out furniture part is explained below with reference to FIGS. 1 to 26. The pull-out guide rails arranged on one side of a pull-out furniture part 2 together with a portion of the pull-out furniture part 2 are illustrated in FIGS. 1 to 22. The furniture cabinet 1 is indicated by dashed lines in FIGS. 2, 3 and 11. The pull-out furniture part 2 can be, for example, a drawer. A plurality of pull-out furniture parts, which are guided displaceably in the same manner, can be arranged in the furniture cabinet 1.

The rails which are arranged on the other side of the pull-out furniture part 2 and are not illustrated in the figures are formed in a mirror-inverted manner.

In the exemplary embodiment, the pull-out guide comprises a cabinet rail 3 to be attached to the furniture cabinet, a pull-out rail 5 to be attached to the pull-out furniture part 2, and a central rail 4, which is arranged between the cabinet rail 3 and the pull-out rail 5, on both sides of the pull-out furniture part.

The pull-out guide can be in particular a roller-type pull-out guide, in which the running rollers 6 supporting the rails 3-5 in a displaceable manner in relation to one another are rotatable about axles which are attached to the rails or to one of the rails. In the exemplary embodiment, all of the running rollers 6 are mounted rotatably on the central rail 4. This involves a differential pull-out mechanism, in which the central rail 4 and pull-out rail 5 run synchronously, in contrast to a telescopic pull-out mechanism, in which the rails are pulled out one after another. However, the invention is also usable with different types of pull-out guides, for example with different types of roller-type pull-out guides, such as roller-type telescopic pull-out mechanisms, in which running rollers are mounted on all of the rails so as to be rotatable about axles.

The pull-out guide may, however, also be a ball-type pull-out guide or a pull-out guide, in which running carriages equipped with running rollers are arranged between the rails.

The pull-out guide could also have just one cabinet rail and one pull-out rail which can be pulled out of the cabinet rail.

In the position of the pull-out furniture part 2 in which it is completely pushed into the cabinet body, the pull-out rail 5 has an insertion position which is pushed completely into the cabinet rail 3 (and into the central rail 4) (FIGS. 1 to 6). In the position of the pull-out furniture part 2 in which the latter is pulled out of the cabinet body 1 to the maximum, the pull-out rail 5 has an extension position pulled maximally out of the cabinet rail 3 (and out of the central rail 4) (FIGS. 15-22). The pull-out furniture part 2 and therefore the pull-out rail 5 are pulled out in a pull-out direction 7. The pull-out furniture part 2 and the pull-out rail 5 are pushed in counter to the pull-out direction 7.

In order to block the pull-out rail 5 in the insertion position and in the extension position, a bolt unit 8 is provided which has a base part 9 which is fastened to the pull-out rail 5 (fastening screws or fastening rivets are not illustrated in the figures for the sake of simplicity; welding could also be provided, for example). A bolt part 10 is mounted on the base part 9 so as to be displaceable linearly in a displacement direction 11 which is preferably at a right angle to the pull-out direction 7. The bolt part 10 is acted upon into a blocking position by a spring element 12. Without an actuation (described further below) of an actuating element 13, in the insertion position and in the extension position of the pull-out rail 5, the bolt part 10 takes up the blocking position, in which it is held by the spring element 12 (FIGS. 1-6, 15-18). In said blocking position, the bolt part 10 interacts with the first stop surface 14 of the cabinet rail 3 in the insertion position of the pull-out rail 5, and, in the extension position of the pull-out rail 5, the bolt part 10 interacts in its blocking position with the second stop surface 15 of the cabinet rail 3. The stop surfaces 14, 15 preferably lie at a right angle to the pull-out direction 7, i.e. their surface normals are oriented parallel to the pull-out direction 7, wherein the first stop surface 14 points in a direction opposed to the pull-out direction 7, i.e. the surface normal to the first stop surface 14 encloses an angle of 180° with the pull-out direction, and the second stop surface 15 is oriented in the pull-out direction, i.e. the surface normal to the second stop surface 15 encloses an angle of 0° with the pull-out direction.

The displacement direction 11 preferably lies horizontally in the installed state. In particular, the bolt unit 8 can be arranged below the base of the pull-out furniture part 2 in the installed state, cf., for example, FIG. 2.

In the exemplary embodiment, the first stop surface 14 is formed by a step in a lower horizontal limb 3*a* of the cabinet rail. Instead, the first stop surface 14 could also be formed by a depression in the lower horizontal limb 3*a* of the cabinet rail 3 (i.e. the lower horizontal limb 3*a* would again have a greater width behind said depression) or could lie on the rear end side of the lower horizontal limb 3*a* of the cabinet rail 3. In the exemplary embodiment, the second stop surface 15 is formed by a front end surface of the horizontal limb 3*a* of the cabinet rail 3. Instead, the second stop surface 15 could also be formed, for example, by a step of the lower horizontal limb 3*a* of the cabinet rail 3 or by a recess in the lower horizontal limb 3*a* of the cabinet rail 3.

In a different design of the rails of the pull-out guide, the first stop surface 14 and the second stop surface 15 could also be arranged by a step or recess in another part of the cabinet rail or on the end side of part of the cabinet rail.

If a force directed in the pull-out direction 7 acts on the pull-out rail 5 from the insertion position thereof, the bolt part 10, which is in its blocking position, blocks the pulling out of the pull-out rail 5 by striking against the first stop surface 14. If, in the extension position of the pull-out rail 5, a force which is oriented counter to the pull-out direction 7 acts on the pull-out rail 5, the bolt part 10, which is in its blocking position, blocks pushing in of the pull-out rail 5 counter to the pull-out direction 7 by striking against the second stop surface 15.

A traction cable 16 is connected to the bolt part 10. By a pull being exerted on the traction cable 16, the bolt part 10 can be displaced from its blocking position counter to the force of the spring element 12 into a release position, in which its interaction with the first or respectively second stop surface 14, 15 is neutralized, cf. FIGS. 7 to 10 and 19 to 22. The pull on the traction cable 16 is undertaken by actuation of an actuating element 13 by a user. The actuating element 13 is preferably arranged, for example mounted displaceably, in the region of the front end side of the pull-out furniture part 2. Instead of a displaceably mounted actuating element 13, a pivotably mounted part could also be provided. The displaceable mounting of the actuating element 13 is not illustrated in detail in the figures.

So that the bolt part 10 is displaced counter to the force of the spring element 12 into the release position by a pull on the traction cable 16, the traction cable 16 runs from its connection to the bolt part 10 in a direction which encloses an angle of less than 90°, preferably less than 45°, with the displacement direction 11. For this purpose, a deflecting part 18, a rotatably mounted deflecting pulley in the exemplary embodiment, is advantageously arranged on the base part 9. The axis of rotation of the deflecting pulley is at a right angle to the pull-out direction 7 and at a right angle to the displacement direction 11. The traction cable 16 could also be deflected by a sliding part arranged on the base part 9.

In the exemplary embodiment, a further deflection of the traction cable 16 is provided in the region of that end of the pull-out rail 5 which is located at the front with respect to the pull-out direction 7. For this purpose, use is made of a deflecting part 19 which is attached to the pull-out rail 5 in the region of its front end with respect to the pull-out direction 7, and which is designed as a sliding part. A deflecting pulley could also be provided. Such a deflecting part 19 could also be omitted if, for example, the actuating element 13 were arranged at the bottom of the pull-out furniture part 2.

In order to keep the traction cable 16 tensioned, use is made of a tensioning part 21 which is acted upon by a tensioning spring 20. In the exemplary embodiment, said tensioning part is designed as a lever which is mounted on the base part 9 so as to be pivotable about a pivot axis 22. This lever is pressed in the region of its free end onto the traction cable 16 by the tensioning spring 20. The pivot axis 22 of the tensioning part 21 is at a right angle to the pull-out direction 7 and at a right angle to the displacement direction 11.

In order to pull the pull-out furniture part 2 in the pull-out direction 7 from the position thereof in which it is completely pushed into the furniture cabinet 1, the bolt part 10 is displaced, by actuation of the actuating element 13, from the blocking position into the release position, in which the bolt part 10 is disengaged from the stop surface 14, cf. FIGS. 7-10. As a result, the pull-out furniture part 2 can be pulled out in the pull-out direction 7 and, with the pull-out furniture part 2, the pull-out rail 5, wherein the actuating element 13 can be released again as soon as the pull-out rail 5 has been brought out of its insertion position. An intermediate position of the pull-out furniture part 2 and of the pull-out guide is illustrated in FIGS. 11-14. When the actuating element 13 is released, the bolt part 10 is pressed onto a running track 23 of the cabinet rail 3 by the spring element 12 when the pull-out rail 5 takes up an intermediate position between the insertion position and the extension position. This running track 23 runs parallel to the pull-out direction 7. When the pull-out rail 5 is displaced in relation to the cabinet rail 3, the bolt part 10 slides with its end surface, which is pressed onto the running track 23, along the running track 23.

For this purpose, the bolt part 10 advantageously has a sliding block 10*a* which is pushed onto a basic body 10*b* of the bolt part 10.

When, by the further pulling out of the pull-out furniture part 2, the pull-out rail 5 reaches the pull-out position, the bolt part 10 has been moved beyond the end of the running track 23 and displaced by the force of the spring element 12 into its blocking position, in which it interacts with the second stop surface 15, cf. FIGS. 15-18.

In order to push in again the pull-out furniture part 2 from its maximally pulled-out position, in which the pull-out rail 5 is in its extension position, the bolt part 10 is displaced by the actuating element 13 from the blocking position into the release position, in which it is disengaged from the second stop surface 15, cf. FIGS. 19-22. As a result, the pull-out furniture part and, with the latter, the pull-out rail 5 can be pushed in counter to the pull-out direction. If the pull-out rail 5 reaches the insertion position, the bolt part 10 has been moved beyond the end of the running track 23 and displaced by the force of the spring element 12 into its blocking position, in which it interacts with the first stop surface 14, cf. FIGS. 1-6.

In the exemplary embodiment, there is a respective angled portion (=edge) between the running track 23 and the first stop surface 14 and between the running track 23 and the second stop surface 15. Instead, a rounded portion could be located between the running track 23 and the first stop surface 14 and/or between the running track 23 and the second stop surface 15. Shortly before the extension position of the pull-out rail 5 is reached (when pulling out the pull-out guide) or the insertion position of the pull-out rail 5 is reached (when pushing in the pull-out guide), a force acting in the pull-out direction 7 (during the pulling out) or counter to the pull-out direction 7 (during the pushing in) would then be brought about by the spring element 12, by which force the pull-out rail 5 could in each case be displaced into its end position.

The base part 9 of the bolt unit 8 has a groove-shaped depression in which the basic body 10*b* of the bolt part 10 is mounted so as to be displaceable parallel to the displacement direction 11.

The basic body 10*b*, which is preferably composed of metal, has a window opening 10*c*, into which a connecting part 17 is clipped. The latter has a cavity into which an end piece 27, which is attached to the end side of the traction cable 16, is insertable in order to connect the traction cable 16 to the bolt part 10.

Instead of the helical spring provided in the exemplary embodiment, another spring element 12 could also be provided for acting upon the bolt part 10 in the blocking position thereof.

The first and/or second stop surface could also be formed on a part attached to the cabinet rail 3.

In the exemplary embodiment, both the pulling out of the pull-out guide and the pushing in of the pull-out guide are blocked. Instead, only the pulling out of the pull-out guide or only the pushing in of the pull-out guide could be blocked. In the non-blocked end position of the pull-out rail, the bolt part 10 would then lie as before against the running track 23.

The rails arranged on both sides of the pull-out furniture part 2 could each be formed together with a described blocking device. The traction cables 16 which are connected to the bolt parts 10 of the two bolt units 8 could then be brought together and connected to a common actuating element 13. The deflecting part 19 illustrated in the figures is suitable for bringing together two such traction cables 16.

A second exemplary embodiment of the invention is illustrated in FIGS. 27-53. Apart from the differences described below, the design corresponds to the first exemplary embodiment and the description of the first exemplary embodiment applies in an analogous manner, together with the possible modifications described. The same reference signs have been used for corresponding p arts.

The second exemplary embodiment differs in relation to the first exemplary embodiment in the actuation of the bolt part 10. For the connection between the actuating element 13' and the bolt part 10, use is made here of an actuating rod 24 and a gear element 25. In order to displace the bolt part 10 between its blocking position and its release position, the actuating element 13' is pushed in and therefore the actuating rod 24 is displaced in the direction of the bolt part 10. The gear element 25 is designed as a transmission arm which is at an angle to the displacement direction 11 and of which a first end 25*a* is connected to the actuating rod 24 and a second end 25*b* is connected to the bolt part 10. The gear element 25 is pivotable here both in relation to the actuating rod 24 and in relation to the bolt part 10, specifically about a respective axis which is at a right angle to the pull-out direction 7 and at a right angle to the displacement direction 11.

In the exemplary embodiment, the second end 25*b* of the gear element 25 is coupled to the bolt part 10 via a connecting part 26. The connecting part 26 here has a hinge pin 26*a* which passes through an opening 25*c* in the gear element 25 and is clipped by a latching arm 26*b* into a window opening 10*c* of the bolt part 10.

The first end 25*a* of the gear element 25 has a guide pin 25*d* which is guided in a displaceable and pivotable manner in a guide groove 9*a* of the base part 9. One end of the actuating rod 24 lies against the first end 25*a* of the gear element 25.

Instead of the gear element 25 described, a different gear element could also be provided, for example a wedge element which has an oblique surface interacting with the bolt part 10.

Instead of pushing in the actuating rod 24 in order to adjust the bolt part 10 from its blocking position into its release position, pulling out of the actuating rod 24 could also be provided. Pushing in or pulling out of the actuating rod 24 could also be brought about, for example, by an actuating element mounted pivotably on the pull-out rod 5 or on the pull-out furniture part 2.

In the first and second exemplary embodiment, the base part 9 and the bolt part 10 are of identical design. The locking device can therefore be optionally equipped in a simple manner with the use of a traction cable 16 according to the first exemplary embodiment and the use of an actuating rod 24 according to the second exemplary embodiment.

Figure 54:
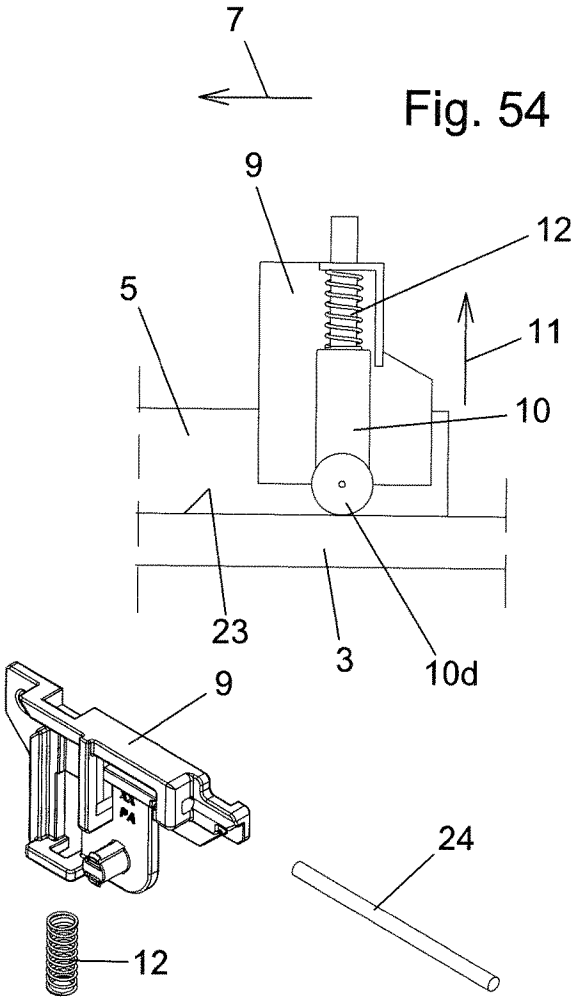
FIG. 54 shows a schematic illustration in a view corresponding to FIG. 12 or FIG. 38 for a modified embodiment, in which the bolt part rolls along the running track.
Figure 52:
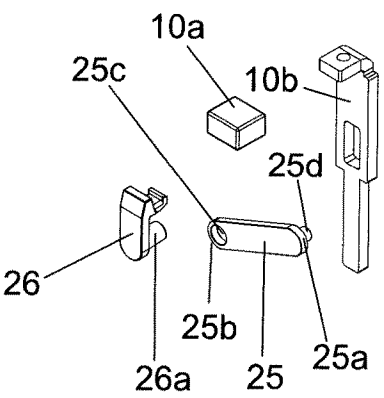
FIGS. 52 and 53 show exploded illustrations of the bolt unit and of the end portion of the actuating rod from different viewing directions.
Figure 53:
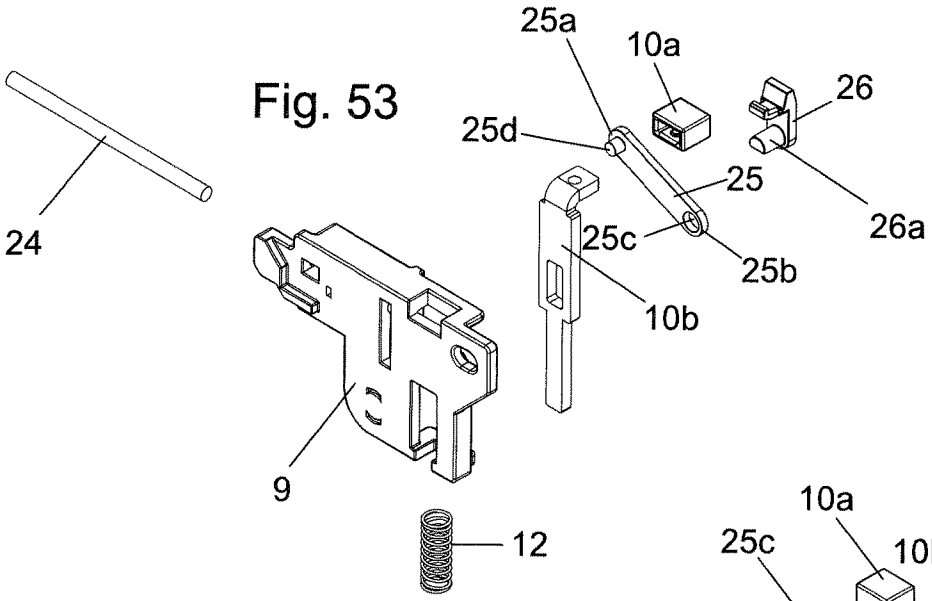
Figure 57:
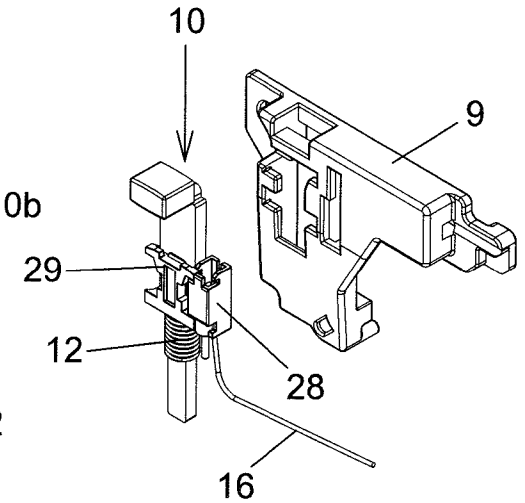
FIG. 57 shows an oblique view corresponding to FIG. 55, but in the removed state of the bolt part.
Figure 56:
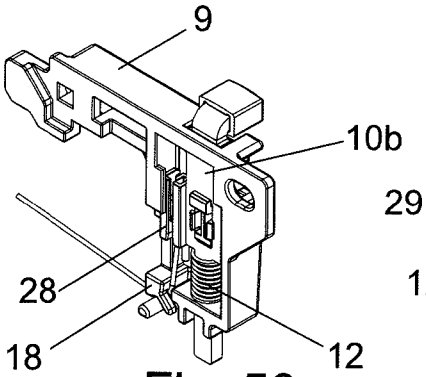
FIG. 56 shows an oblique view of the opposite side (facing the pull-out furniture part) of the bolt unit.
Figure 55:
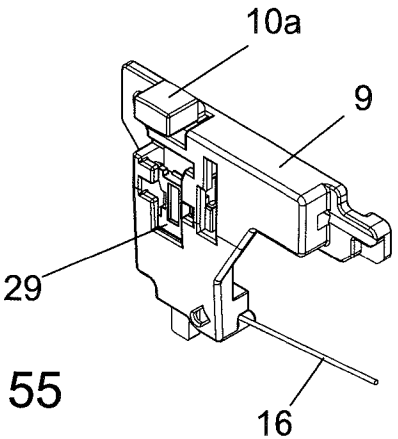
FIG. 55 shows an oblique view analogously to FIG. 24 of a modified bolt unit.
Figure 59:
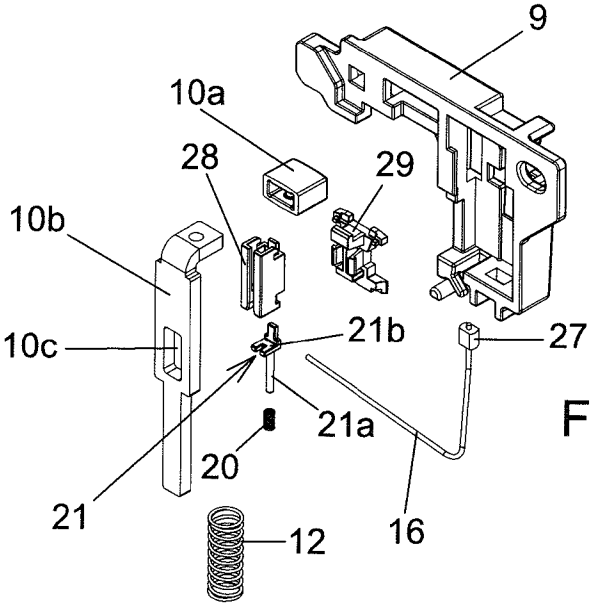
FIGS. 58 and 59 show exploded illustrations from different viewing directions.
Figure 58:
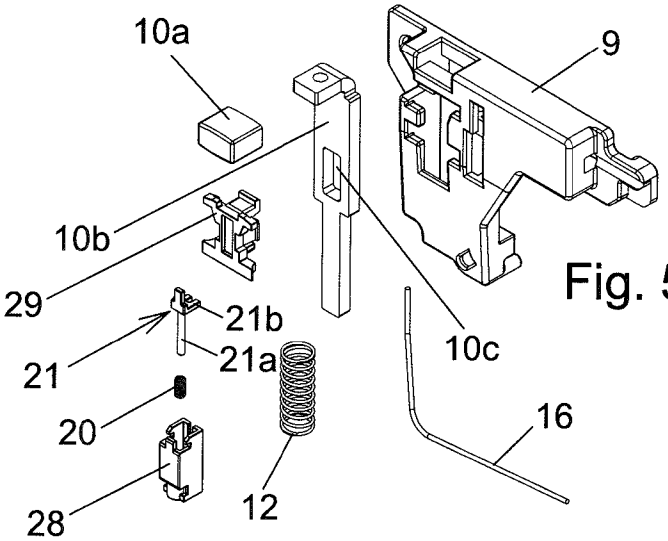
Figure 60:
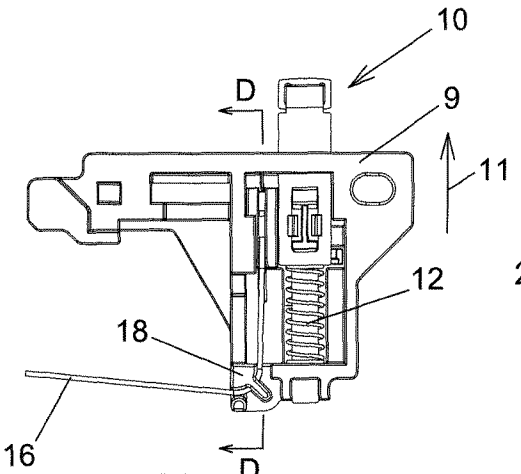
FIG. 60 shows a view of that side of the bolt unit which faces the pull-out furniture cabinet.

FIG. 54 schematically shows a bolt part 10 which is equipped with a rotatably mounted roller 10*d* and rolls along the running track 23 during the pulling out and pushing in of the pull-out rail 5. Such a bolt part 10 having a rotatably mounted roller 10*d* can be used both in the first and in the second exemplary embodiment. Elements actuating the bolt part 10, such as a traction cable 16 or an actuating rod 24, have been left out in the schematic FIG. 54 for the sake of simplicity.

A modified design of the bolt unit 8 which can be used instead of the bolt unit described in conjunction with the first exemplary embodiment is illustrated in FIGS. 55-64. Apart from the differences described below, the design corresponds to that of the first exemplary embodiment. The same reference signs as in the first exemplary embodiment are used for identical or at least analogous parts.

The essential difference of this modified embodiment consists in the manner of tensioning the traction cable 16. A linearly displaceable tensioning part 21 is provided here for this purpose. The tensioning part 21 is mounted so as to be displaceable in relation to the bolt part 10 parallel to the displacement direction 11, wherein the bolt part 10 in turn is mounted so as to be displaceable linearly in the displacement direction 11 in relation to the base part 9 (of somewhat modified design).

The displaceable mounting of the tensioning part 21 by the bolt part 10 takes place by a bearing part 28 which is connected via a connecting part 29 to the basic body 10*b* of the bolt part 10. The bearing part 28 has an inner extent, into which the tensioning part 21 is inserted and is mounted displaceably. Located between the tensioning part 21 and a base 28*a* of the bearing part 28 is a tensioning spring 20 which is designed as a helical spring and surrounds a pin-like extension 21*a* of the tensioning part 21. The end piece 27 of the traction cable 16 (missing in FIG. 58) rests on a base 21*b* of the tensioning part 21, wherein the traction cable 16 passes through a slot in the base 21*b*.

The traction cable 16 runs from the tensioning part 21 in a direction parallel to the displacement direction 11 and is then deflected by a deflecting part 18, which is formed integrally here with the base part 9, in a direction which, in the exemplary embodiment, encloses an angle of less than 30° with the pull-out direction, wherein larger angles are also possible.

Figure 61:
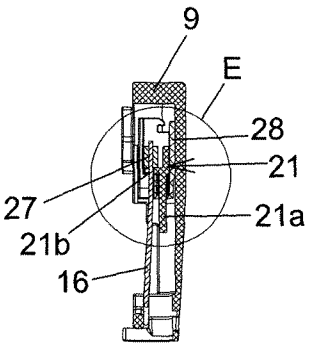
FIG. 61 shows a section along the line DD from FIG. 60.
Figure 62:
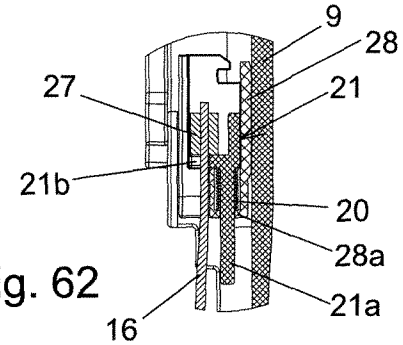
FIG. 62 shows an enlarged detail E of FIG. 61.

During the adjustment of the bolt part 10 from its blocking position into its release position by a pull exerted on the traction cable 16 by the actuating element 13, the tensioning part 21 is displaced maximally in the direction of the base 28*a* of the bearing part 28, cf. FIGS. 61 and 62. In this state, the tensioning part 21 lies against a stop surface 28*b* of the bearing part 28. Alternatively, the tensioning spring 20 could also be tensioned to the limit.

Figure 63:
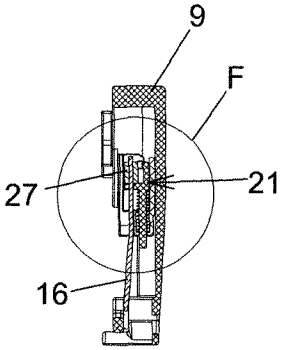
Figure 64:
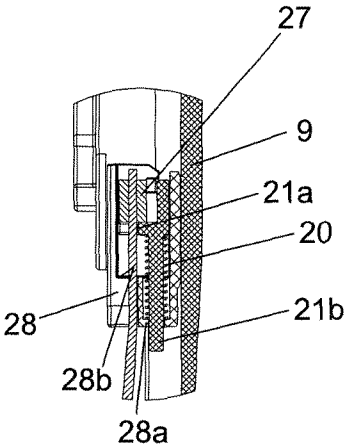
FIG. 64 shows an enlarged detail F of FIG. 63.

When, during the pulling out or pushing in of the pull-out rail 5, the bolt part 10 lies against the running track 23 and slides (or rolls) along the latter, cf. FIGS. 11 to 14, the tensioning part 21 is displaced by the tensioning spring 20 until the traction cable 16 remains tensioned, cf. FIGS. 63 and 64.

The bolt part could also be formed in a different manner in order to displaceably support a tensioning part 21, wherein a tensioning spring acts upon the tensioning part 21. The connecting part 29 and the bearing part 28 could also be dispensed with, and the elements supporting the tensioning part 21 could also be formed integrally with a (metallic) basic body of the bolt part. In the exemplary embodiment shown, the connecting part 29 and the bearing part 28 are formed from plastic and are fastened to each other and to the basic body 10*b* via clip connections.

The tensioning part 21 could also be mounted displaceably in relation to the bolt part 10 at an angle to the displacement direction 11 (wherein this angle would preferably be smaller than 30°), and/or the traction cable 16 could also emerge from the tensioning part 21 in a direction at an angle to the displacement direction 11, wherein the angle between the direction of the displaceable mounting of the tensioning part 11 and the traction cable 16 adjoining the tensioning part 21 would preferably be smaller than 30°.

It would also be conceivable and possible to displaceably support a tensioning part, which acts on the traction cable 16, on the base part 9 of the bolt unit 8 under the action of a tensioning spring (parallel to the displacement direction 11 or at an angle thereto which is preferably smaller than 30°).

| Key to the Reference Numbers: | |
|---|---|
| 1 | Furniture cabinet |
| 2 | Pull-out furniture part |
| 3 | Cabinet rail |
| 3a | Horizontal limb |
| 4 | Central rail |
| 5 | Pull-out rail |
| 6 | Running roller |
| 7 | Pull-out direction |
| 8 | Bolt unit |
| 9 | Base part |
| 9a | Guide groove |
| 10 | Bolt part |
| 10a | Sliding block |
| 10b | Basic body |
| 10c | Window opening |
| 10d | Roller |
| 11 | Displacement direction |
| 12 | Spring element |
| 13, 13' | Actuating element |
| 14 | First stop surface |
| 15 | Second stop surface |
| 16 | Traction cable |
| 17 | Connecting part |
| 18 | Deflecting part |
| 19 | Deflecting part |
| 20 | Tensioning spring |
| 21 | Tensioning part |
| 21a | Extension |
| 21b | Base |
| 22 | Pivot axis |
| 23 | Running track |
| 24 | Actuating rod |
| 25 | Gear element |

-continued

| Key to the Reference Numbers: | |
|---|---|
| 25a | First end |
| 25b | Second end |
| 25c | Opening |
| 25d | Guide pin |
| 26 | Connecting part |
| 26a | Hinge pin |
| 26b | Latching arm |
| 27 | End piece |
| 28 | Bearing part |
| 28a | Base |
| 28b | Stop surface |
| 29 | Connecting part |

The invention claimed is:

1. A pull-out guide for a pull-out furniture part which can be pulled out of a furniture cabinet, the pull-out guide comprising:

a cabinet rail which is attachable to the furniture cabinet, a pull-out rail which is attachable to the pull-out furniture part and is adapted to be pulled out in a pull-out direction from a completely pushed-in insertion position into a completely pulled-out extension position, and is adapted to be pushed into the insertion position from the extension position counter to the pull-out direction, a bolt part for blocking at least one of the pulling out of the pull-out rail from the insertion position of the pull-out rail or the pushing in of the pull-out rail from the extension position of the pull-out rail, the bolt part is adjustable by an actuating element from a blocking position, in which the bolt part blocks the pulling out of the pull-out rail from the insertion position of the pull-out rail or blocks the pushing in of the pull-out rail from the extension position of the pull-out rail, into a release position, in which the bolt part releases the pulling out of the pull-out rail from the insertion position of the pull-out rail or releases the pushing in of the pull-out rail from the extension position of the pull-out rail, a spring element that holds the bolt part in the blocking position in at least one of the insertion position of the pull-out rail or the extension position of the pull-out rail, an actuation element by which the bolt part is adjustable from the blocking position into the release position counter to the force of the spring element, the cabinet rail including a running track along which the bolt part slides or rolls during the pulling out and pushing in of the pull-out rail, the bolt part being pressed onto the running track by the spring element, the bolt part is guided displaceably parallel to a displacement direction by a base part, and is displaceable from the blocking position in the displacement direction into the release position counter to the spring force of the spring element by actuation of the actuating element; and a traction cable by which the actuating element is connected to the bolt part.

2. The pull-out guide as claimed in claim 1, further comprising a tensioning part that is acted upon by a tensioning spring to tension the traction cable.

3. The pull-out guide as claimed in claim 2, wherein the tensioning part comprises a lever that is mounted pivotably about a pivot axis and is pressed in a region of a free end thereof onto the traction cable by the tensioning spring.

4. The pull-out guide as claimed in claim 2, wherein the tensioning part is supported by the bolt part so as to be displaceable linearly parallel to the displacement direction and interacts with an end piece of the traction cable.

5. The pull-out guide as claimed in claim 1, wherein the displacement direction is at a right angle to the pull-out direction.

6. The pull-out guide as claimed in claim 1, wherein the displacement direction lies horizontally in an installed state of the pull-out guide.

7. The pull-out guide as claimed in claim 6, further comprising a deflecting part arranged on the base part, and the traction cable via which the actuating element is connected to the bolt part is guided via the deflecting part.

8. The pull-out guide as claimed in claim 7, wherein the deflecting part is a deflecting pulley mounted rotatably on the base part.

9. The pull-out guide as claimed in claim 1, wherein, in the blocking position, the bolt part interacts with a stop surface arranged on the cabinet rail.

10. The pull-out guide as claimed in claim 9, wherein the stop surface is at a right angle to the pull-out direction.

11. The pull-out guide as claimed in claim 1, wherein the running track runs along the cabinet rail parallel to the pull-out direction.

12. A pull-out guide for a pull-out furniture part which can be pulled out of a furniture cabinet, the pull-out guide comprising:

a cabinet rail which is attachable to the furniture cabinet, a pull-out rail which is attachable to the pull-out furniture part and is adapted to be pulled out in a pull-out direction from a completely pushed-in insertion position into a completely pulled-out extension position, and is adapted to be pushed into the insertion position from the extension position counter to the pull-out direction, a bolt part for blocking at least one of the pulling out of the pull-out rail from the insertion position of the pull-out rail or the pushing in of the pull-out rail from the extension position of the pull-out rail, the bolt part is adjustable by an actuating element from a blocking position, in which the bolt part blocks the pulling out of the pull-out rail from the insertion position of the pull-out rail or blocks the pushing in of the pull-out rail from the extension position of the pull-out rail, into a release position, in which the bolt part releases the pulling out of the pull-out rail from the insertion position of the pull-out rail or releases the pushing in of the pull-out rail from the extension position of the Dull-out rail, a spring element that holds the bolt part in the blocking position in at least one of the insertion position of the pull-out rail or the extension position of the pull-out rail, an actuation element by which the bolt part is adjustable from the blocking position into the release position counter to the force of the spring element, the cabinet rail including a running track along which the bolt part slides or rolls during the pulling out and pushing in of the pull-out rail, the bolt part being pressed onto the running track by the spring element, the bolt part is guided displaceably parallel to a displacement direction by a base part, and is displaceable from the blocking position in the displacement direction into the release position counter to the spring force of the spring element by actuation of the actuating element; and an axially displaceable actuating rod and at least one gear element, and the actuating element is connected to the bolt part via the axially displaceable actuating rod and the at least one gear element.

13. The pull-out guide as claimed in claim 12, wherein the gear element is a transmission arm having a first end that interacts with the actuating rod and is displaceable by the actuating rod, and having a second end by which the bolt part is displaceable from the blocking position into the release position counter to the force of the spring element, and the transmission arm is oriented at an angle to the actuating rod and at an angle to the displacement direction of the bolt part and is pivotable in relation to the actuating rod and in relation to the bolt part.

14. The pull-out guide as claimed in claim 12, wherein the displacement direction is at a right angle to the pull-out direction.

15. The pull-out guide as claimed in claim 12, wherein the displacement direction lies horizontally in an installed state of the pull-out guide.

16. The pull-out guide as claimed in claim 12, wherein, in the blocking position, the bolt part interacts with a stop surface arranged on the cabinet rail.

17. The pull-out guide as claimed in claim 16, wherein the stop surface is at a right angle to the pull-out direction.

18. The pull-out guide as claimed in claim 12, wherein the running track runs along the cabinet rail parallel to the pull-out direction.

* * * * *